US009150229B2

(12) United States Patent
Steffen et al.

(10) Patent No.: US 9,150,229 B2
(45) Date of Patent: Oct. 6, 2015

(54) SYSTEMS AND METHOD FOR CONTROLLING WARNINGS AT VEHICLE CROSSINGS

(71) Applicant: GENERAL ELECTRIC COMPANY, Schenectady, NY (US)

(72) Inventors: Michael Steffen, Lee's Summit, MO (US); Jesse Herlocker, Melbourne, FL (US); Jeffrey Michael Fries, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/285,231

(22) Filed: May 22, 2014

(65) Prior Publication Data

US 2014/0361126 A1 Dec. 11, 2014

Related U.S. Application Data

(63) Continuation-in-part of application No. 13/910,412, filed on Jun. 5, 2013.

(60) Provisional application No. 61/835,830, filed on Jun. 17, 2013.

(51) Int. Cl.
*B61L 29/04* (2006.01)
*B61L 29/32* (2006.01)
*B61L 29/22* (2006.01)

(52) U.S. Cl.
CPC *B61L 29/32* (2013.01); *B61L 29/22* (2013.01)

(58) Field of Classification Search
CPC ..... B61L 29/32; B61L 29/22
USPC ..... 701/465
See application file for complete search history.

(56) References Cited

U.S. PATENT DOCUMENTS

| | | | | |
|---|---|---|---|---|
| 5,098,044 | A * | 3/1992 | Petit et al. | 246/187 A |
| 6,824,110 | B2 | 11/2004 | Kane | |
| 7,089,093 | B2 | 8/2006 | Lacote | |
| 7,618,010 | B2 | 11/2009 | Fries | |
| 7,769,544 | B2 * | 8/2010 | Blesener et al. | 701/301 |
| 7,966,126 | B2 | 6/2011 | Willis | |
| 8,214,091 | B2 | 7/2012 | Kernwein | |
| 8,255,144 | B2 * | 8/2012 | Breed et al. | 701/117 |
| 8,406,940 | B2 | 3/2013 | Otsubo | |
| 8,469,319 | B2 * | 6/2013 | Kiss et al. | 246/125 |
| 2004/0249571 | A1 * | 12/2004 | Blesener et al. | 701/301 |
| 2009/0177344 | A1 | 7/2009 | James | |
| 2009/0184214 | A1 * | 7/2009 | Reibeling et al. | 246/125 |
| 2011/0084176 | A1 | 4/2011 | Reichelt | |
| 2011/0133038 | A1 * | 6/2011 | Kiss et al. | 246/126 |
| 2012/0248261 | A1 * | 10/2012 | Nichter | 246/125 |
| 2013/0015297 | A1 | 1/2013 | Steffen, II et al. | |
| 2013/0270395 | A1 | 10/2013 | Steffen, II et al. | |

* cited by examiner

*Primary Examiner* — Mary Cheung
*Assistant Examiner* — Anna Mazzara
(74) *Attorney, Agent, or Firm* — GE Global Patent Operation

(57) ABSTRACT

A method includes receiving an absolute time associated with movement of a vehicle system, modifying the absolute time into a relative time, and controlling one or more warning devices using the relative time. A system includes a crossing module configured to receive an absolute time associated with movement of a vehicle system. The crossing module is configured to modify the absolute time into a relative time and to control one or more warning devices using the relative time.

22 Claims, 7 Drawing Sheets

SYSTEMS AND METHOD FOR CONTROLLING WARNINGS AT VEHICLE CROSSINGS

CROSS-REFERENCE TO RELATED APPLICATIONS

This application claims priority to U.S. Provisional Patent Application No. 61/835,830, which was filed on 17 Jun. 2013, and is titled "Systems And Methods For Controlling Warnings At Vehicle Crossings" (referred to herein as the "'830 application"). This application also is a continuation-in-part of U.S. patent application Ser. No. 13/910,412, which was filed on 5 Jun. 2013, and is titled "Systems And Methods For Providing Constant Warning Time At Crossings" (referred to herein as the "'412 application"). The entire disclosures of the '830 application and the '412 application are incorporated by reference.

FIELD

Embodiments of the subject matter described herein relate to vehicle location systems and methods, and more particularly, to systems and methods for providing warning times at crossings.

BACKGROUND

A vehicle transportation system may include routes over which vehicles travel. These routes may cross routes of other transportation systems, such as where rail tracks and road or highway systems cross over each other. To warn the vehicles, crossing gates may be provided at locations where the routes intersect, with the crossing gates configured to warn operators of the vehicles and inhibit (e.g., prevent) vehicles from crossing a route while another vehicle is traveling on the route at or near the crossing.

Some known railroad crossings use a warning predictor track circuit that detects motion of a rail vehicle toward the crossing. Warning predictors (also referred to as crossing predictors) may calculate the time of arrival of the rail vehicle to the crossing based on the motion that is detected. The warning predictors activate crossing warning devices (e.g., lights, gates, bells, speakers, or the like) a specified (e.g., designated) amount of time prior to arrival of the rail vehicle at the crossing. The designated amount of time may be set by a government regulation, by the operator or owner of the rail vehicle or crossing, or another entity. Optionally, the designated amount of time may be set to exceed such a regulation or time that is set by the operator, owner, or other entity. Crossing predictors are commonly used where there are mixed rail vehicle types (freight, passenger, or the like) traveling along the routes, and/or where speeds of the rail vehicles may vary dramatically.

In some systems, for example rail systems that use catenaries or third rails to provide energy to rail vehicles, electrical interference may be too high for predictor systems to function accurately. Thus, in some applications, crossing gates or lights may be activated based on occupancy of the route by a rail vehicle within a given distance of a crossing, without respect to relative speed or arrival time of the rail vehicle at the crossing. If track circuits that simply activate the crossing based on occupancy of the route are used (as opposed to detecting motion of the rail vehicle), the warning times provided at the crossing can vary significantly depending upon the speed of approach of the rail vehicle. Long warning times can be undesirable because of the unnecessary delay caused to operators of other vehicles trying to move through the crossing. Overly long warning times may tempt impatient operators of such vehicles to move the vehicles around the crossing gates and/or disregard audible or visible warnings if the operators do not see any rail vehicles imminently approaching after some period of time.

Traditional predictor circuits are limited by practical considerations to a range extending a given distance from a crossing. Thus, vehicles may travel at a speed that exceeds the ability of the predictor circuit to detect presence of the vehicle in time to lower a gate within a desired or designated time range. Some systems account for such speeds exceeding the ability of the predictor circuit by sending a message from the approaching vehicle when traveling at such faster speeds before encountering the effective range of the predictor circuit. The term "approaching vehicle" refers to the vehicle that is traveling toward the crossing and for which the warning system is to be activated to warn operators of other vehicles at the crossing and/or prevent these other vehicles from traveling through the crossing until the approaching vehicle completes passage through the crossing. The effective range of the predictor circuit represents the distance or locations in which the predictor circuit is able to identify the presence of a vehicle traveling toward the crossing. The message that is sent by the vehicle to the predictor circuit can communicate a relative time (e.g., time from when the message was sent) that represents when the vehicle is expected to arrive at the crossing. For example, the message may indicate that the approaching vehicle expects to arrive at the crossing in one minute from the time that the message was sent by the vehicle. Delays in sending, receiving, and/or processing the message with such as relative time may result in initiation of closing the crossing or otherwise warning other vehicles at the crossing at a time exceeding a desired time for closing, in order to account for worst case delays, which may be around ten seconds or more. In such systems, crossings will frequently activate earlier than desired, resulting in overly long waiting periods, and resulting in inconsistent wait times for operators of vehicles waiting at the crossing. Such systems also fail to address issues resulting from relatively slower speeds of the vehicle that is approaching the crossing.

In some known warning systems, equipment disposed onboard an approaching vehicle was able to activate warning systems at crossings that are controlled by wayside units disposed at or near the crossings. The onboard equipment sends a single message to the wayside unit when the approaching vehicle is traveling toward the crossing. This single message indicates a relative time of when the approaching vehicle expects to reach the crossing. For example, the single message may indicate that the approaching vehicle expects to arrive at the crossing in forty-five seconds. When the designated warning time occurs, the wayside unit activates the warning system at the crossing.

These known warning systems are not without drawbacks. Because only a single message is communicated from the onboard system to the wayside unit, this single message may not be received and/or may be degraded or interfered with due to various problems with communication and/or external interferences with communication. Additionally, these systems communicate the message with a built-in buffer time period to allow for changes in the speed of the approaching vehicle and/or to account for delays in communicating with the wayside units. For example, the relative time communicated by the message may include both the time period that the approaching vehicle expects to use to travel to the crossing and an additional buffer time period that allows the approaching vehicle to accelerate during travel toward the crossing while still activating the warning system before the vehicle arrives at the crossing. Because of this additional, built-in buffer time period, the warning system may activate too soon and other vehicles at the crossing may be warning of the approaching vehicle too soon. As described above, impatient operators of these other vehicles may attempt to circumvent such a warning system by attempting to drive through the crossing ahead of the approaching vehicle.

BRIEF DESCRIPTION

As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

In one embodiment, a method (e.g., for controlling warnings at crossings) includes receiving one or more absolute times associated with movement of a vehicle system. The one or more absolute times are communicated from the vehicle system to notify of at least one of an arrival or departure of the vehicle system at a crossing between a first route being traveled by the vehicle system and a second route. The method also includes modifying at least one of the one or more absolute times into a first relative time and controlling one or more warning devices using the first relative time. The one or more warning devices are controlled to at least one of notify one or more other vehicles traveling along the second route of the at least one of arrival or departure of the vehicle system at the crossing or prevent the one or more other vehicles from traveling through the crossing along the second route.

In another embodiment, a system (e.g., a warning crossing system) includes a crossing module configured to receive one or more absolute times associated with movement of a vehicle system. The one or more absolute times can be communicated from the vehicle system to notify of at least one of an arrival or departure of the vehicle system at a crossing between a first route being traveled by the vehicle system and a second route. The crossing module can be configured to modify at least one of the one or more absolute times into a first relative time and to control one or more warning devices using the first relative time. The one or more warning devices can be controlled to at least one of notify one or more other vehicles traveling along the second route of the at least one of arrival or departure of the vehicle system at the crossing or prevent the one or more other vehicles from traveling through the crossing along the second route.

In another embodiment, a system (e.g., a warning crossing system) includes a crossing module and one or more warning devices. The crossing module includes one or more computer processors configured to receive an absolute time associated with movement of a first vehicle system along a first route toward a crossing between the first route and a second route. The absolute time represents at least one of an arrival time of the first vehicle system at the crossing or a departure time at which the vehicle system is expected to complete passage through the crossing. The crossing module also can be configured to modify the absolute time into a relative time. The one or more warning devices include at least one of a gate or a light. The crossing module is configured to at least one of activate the gate upon expiration of the relative time to prevent passage of one or more other vehicles through the crossing along the second route, activate the light upon expiration of the relative time to notify the one or more other vehicles of arrival of the first vehicle system at the crossing, or activate the gate to prevent the one or more other vehicles from passing through the crossing along the second route until the relative time indicates that the first vehicle system has completed passage through the crossing along the first route.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
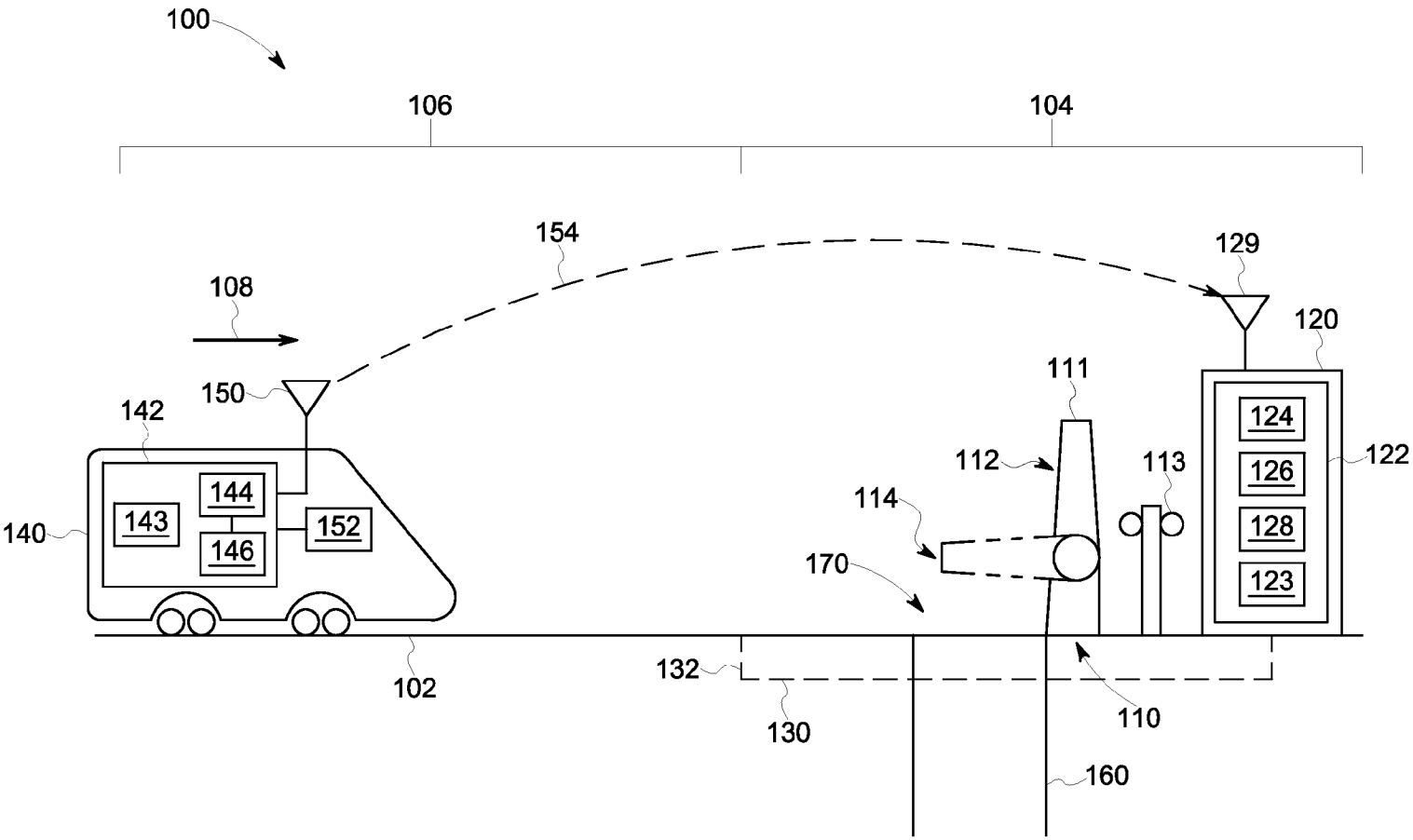
FIG. 1 is a schematic view of a transportation system in accordance with an embodiment.

One or more embodiments of the inventive subject matter described herein provide systems and methods for improved operation of crossings for transportation systems, such as crossings associated with an intersection between a rail system and a road or highway system. In various embodiments, an onboard system is provided that is configured to control movement of a rail vehicle and to communicate with a crossing module or system, such as wayside equipment controlling the crossing. The control systems for the rail vehicle, for example, may be configured to be compatible with Positive Train Control (PTC) systems utilized in the United States. In various embodiments, bidirectional communications between onboard equipment and wayside equipment may be used to activate and deactivate crossing warning (or closing) systems when necessary to provide a substantially consistent amount of warning time. For example, the crossing warning systems may be activated no longer than a designated amount of time before an approaching vehicle passes through a crossing, even if the vehicle changes speeds while approaching the crossing and after the presence or approach of the vehicle is detected. In various embodiments, an onboard system is configured to communicate an arrival time at a crossing (or a time to initiate warning or closing of a crossing) regardless of the speed at which the rail vehicle is traveling. This time may also be used to preemptively clear out traffic from an intersection prior to closing the crossing. The time may be communicated before the rail vehicle enters an effective range of an automatic closing (or warning) system. In various embodiments, an absolute time is communicated to the crossing module (e.g., wayside equipment), so that crossing activation may be accomplished consistently and without having to factor in delay times to account for sending a message, receiving a message, or the like.

A technical effect of embodiments includes reduction of delays in operating crossing activation systems. A technical effect of embodiments includes improved consistency in warning times provided at crossings, for example to motorists encountering a rail crossing. A technical effect of embodiments includes reduction of inconvenience and/or confusion to motorists or others at a crossing. A technical effect of embodiments is the reduction of temptation to motorists to drive around a closed gate at a crossing, disregard a warning provided at a crossing, or engage in other unsafe behavior. A technical effect of embodiments is the reduction of accidents at crossings. A technical effect of embodiments is the improvement of crossing gate and/or warning systems in conjunction with electrified systems for which predictor circuits may not be employed effectively. A technical effect of embodiments is the operation of crossing warning systems without requiring the use of approach track detection circuits (in various embodiments where an approach circuit is not used, an island circuit may still be utilized). A technical effect of embodiments is the improvement of crossing gate or warning activation at relatively slower vehicle speeds and/or reduction of gate pump.

Throughout this document, the term vehicle consist may be used. A vehicle consist is a group of any number of vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist can also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, can have sub-consists. Specifically, there can be a lead consist (of propulsion units), and one or more remote consists (of propulsion units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit can control the operations of the trail or remote propulsion units, even though the lead propulsion unit may or may not be disposed at a front or leading end of the vehicle consist along a direction of travel. A vehicle consist can be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

FIG. 1 depicts a schematic view of a transportation system 100 in accordance with an embodiment. The system 100 includes a crossing warning system 110, a crossing module or system 120, a track detection system 130, and a vehicle system 140. In the embodiment depicted in FIG. 1, the vehicle system 140 is shown traveling over a first route 102 in a direction 108 toward a crossing 170. The crossing 170 corresponds to intersection of the first route 102 with a second route 160. The first route 102, for example, may be configured as a railroad track over which a rail vehicle may travel. The second route 160 in the illustrated embodiment is a road or highway that is paved, leveled, or otherwise configured for automobile and/or truck travel. In some embodiments, the crossing may be understood as a "highway crossing at grade."

The vehicle system 140 may represent a single propulsion-generating vehicle, or a consist formed from two or more vehicles mechanically coupled together. For example, the vehicle system 140 may include at least one propulsion-generating vehicle (e.g., locomotive, automobile, off-highway vehicle, or the like) and at least one non-propulsion-generating vehicle (e.g., a railcar) coupled together to travel together along the route. As one example, the vehicle system 140 may represent a train, although not all embodiments described herein are limited to trains or rail vehicles.

The crossing warning system 110 and the crossing module 120 are associated with and disposed proximate the crossing 170. The crossing warning system 110 and the crossing module 120 are configured to impede (e.g., prevent) access through the crossing 170 via the second route 160 (e.g., paved road accessible to automobiles) when the vehicle system 140 passes by or through the crossing 170 along the first route 102 (e.g., rail system).

The track detection system 130 depicted in FIG. 1 has an effective range 104. In FIG. 1, the vehicle system 140 is depicted in a territory 106 outside of the effective range 104 and moving in direction 108 toward the crossing 170 and toward entering the effective range 104 of the track detection system 130.

It should be noted that FIG. 1 is schematic in nature and intended by way of example. In various embodiments, various aspects or modules may be omitted, modified, or added. Further, various modules, systems, or other aspects may be combined. Yet further still, various modules or systems may be separated into sub-modules or sub-systems and/or functionality of a given module or system may be shared between or assigned differently to different modules or systems.

The depicted crossing warning system 110 is configured to impede travel through the crossing 170 along the second route 160 when the crossing warning system 110 is activated. The crossing warning system 110, when activated, may provide one or more of an audible warning (e.g., bell), visible warning (e.g., flashing lights), and/or a physical barrier (e.g., gate). In the illustrated embodiment, the crossing warning system 110 includes a gate 111 that may be raised to an open position 112 to allow traffic through the crossing 170 along the second route 160 or lowered to a closed position 114 to impede traffic through the crossing 170 along the second route 160. The depicted crossing warning system 110 also includes a crossing warning indicator 113 configured to provide a visual and/or audible indication. In various embodiments, the crossing warning indicator 113 may include one or more of lights, bells, or the like. In some embodiments, as used herein, impeding travel along a particular route may not present an absolute bar to travel along the route. For example, travel along a route may be impeded by warning against travel through a crossing, discouraging travel through a crossing, blocking travel through a crossing, instructing against travel through a crossing, or otherwise inhibiting travel through a crossing. For instance, the gate 111 may be placed in the closed position 114 to impede the passage of traffic through the crossing 170 along the second route 160; however, a motorist may attempt to evade the gate 111 by driving around the gate 111. Similarly, a motorist may ignore warning bells or lights. Various embodiments provide improved consistency in warning times to reduce the temptation of motorists to evade or ignore a crossing warning.

In the illustrated embodiment, the crossing module 120 is disposed along the route 102 along which the vehicle 140 is configured to travel proximate to the crossing 170. The crossing module is operably connected to the crossing warning system 110 and is configured to operate the crossing warning system 110 to allow traffic though the crossing 170 along the second route 160 when no vehicles are traversing through the crossing 170 along the first route 102 (or are within a specified time and/or distance of the crossing 170), and to impede traffic through the crossing 170 along the second route 160 when a vehicle is traversing through the crossing 170 along the first route 102 (or is within a specified time and/or distance of the crossing 170). The crossing module 120 may operate the crossing warning system 110 based on instructions or information received from one or more of the vehicle system 140 or the track detection system 130. The crossing module 120 depicted in FIG. 1 includes a processing unit 122 and an antenna 129. In various embodiments, the crossing module 120 may be configured as wayside equipment.

The processing unit 122 of the illustrated embodiment includes a memory 123, a communication module 124, a crossing determination module 126, and an automatic closure module 128. In the illustrated embodiment, the communication module 124 is configured to wirelessly receive messages from and/or transmit messages to the vehicle system 140 via the antenna 129. In alternate embodiments, the communication module 124 (and the communication module 146 of the vehicle system 140) may be configured to communicate over different media, such as over one or more rails of the transportation system 100. The crossing determination module 126 is configured to determine an activation time to activate the crossing warning system 110 and to activate or deactivate the crossing warning system 110 based on the presence of a vehicle along the first route 170 at or near the crossing 170 (e.g., within a specified closing or warning time or distance). It should be noted that FIG. 1 is intended by way of example and is schematic in nature. In various embodiments, various modules (or portions thereof) of the processing unit 122 may be added, omitted, arranged differently, or joined into a common module, various portions of a module or modules may be separated into other modules or sub-modules and/or be shared with other modules, or the like.

The communication module 124 is configured to communicate messages or information with the vehicle system 140. The communication module 124 may be configured to one or more of receive messages, transmit messages, pre-process information or data received in a message, format information or data to form a message, decode a message, decrypt or encrypt a message, compile information to form a message, extract information from a message, or the like. In the illustrated embodiment, the communication module 124 utilizes the antenna 129 to communicate with the vehicle system 140. For example, the communication module 124 may receive a message 154 transmitted from the vehicle system 140 via the antenna 129. As discussed herein, the message 154 may be transmitted before the vehicle system enters the range 104 and may include information corresponding to one or more of a time to activate the crossing warning system 110, suppression of an activation of the crossing warning system 110 indicated by the track detection system 130, or identification of a sub-route upon which the vehicle system 140 is traveling.

For example, the message 154 may include timing information that includes a reference time corresponding to a time for impeding travel along the second route through the crossing. In various embodiments, the reference time may be a time at which the vehicle system 140 is projected to arrive at the crossing 170. In various embodiments, the reference time may be a time at which the crossing module 120 is to activate the crossing warning system 110 (e.g., a time a predetermined amount before the time at which the vehicle system 140 arrives at or passes through the crossing 170). In the illustrated embodiment, the reference time is an absolute time. An absolute time may be understood as a time specified in accordance with a synchronization scheme where other entities use the same scheme. For example, clocks associated with and/or accessible by both the vehicle system 140 and the crossing module 120 may be synchronized via a common precision time reference such as a time provided by a global positioning system (GPS) or Network Time Protocol (NTP). Examples of absolute times include coordinated universal time (UTC) and Greenwich mean time (GMT). In contrast to an absolute time, a relative time may be understood as a time described with reference to a particular event (e.g., 30 seconds from a time of receiving a message, 20 seconds from a time of receiving a message, or the like).

In various embodiments, use of an absolute time, in contrast to a relative time, helps provide more consistent warning times and/or avoids delays to motorists and/or overly long warning or closure periods. For example, use of a relative time requires the factoring in of additional time to account for delays in transmission, reception, and/or comprehension of a message. By way of example, a communication system may have a worst case delay of about ten seconds for sending, receiving, and comprehending a message indicating a closing time for a crossing gate. To meet a desired time for activation or closing of the gate therefore, about ten seconds must be added to the desired time, to ensure that the desired time is met in worst case delay scenarios. Thus, for a system with a 10 second worst case delay for messaging, the activation time must be set at least 10 seconds early to account for the worst case delay. Because the worst case delay is generally not the most common case, the crossing warning or closure will thus be frequently activated earlier than desired. For example, in cases where there is little or no delay in messaging, the crossing warning will be activated about ten seconds early. If there are about two seconds of messaging delay, the crossing warning will be activated about eight seconds early. Thus, the crossing warning for systems utilizing a relative time may provide motorists with inconsistent warning times and/or inappropriately lengthy crossing closures. In various embodiments, use of timing information configured in terms of an absolute time does not require accounting for messaging delay, and reduces or eliminates such inconsistency and/or delay.

In various embodiments, information regarding track occupancy, status of switches, or other information utilized, for example, in conjunction with a positive control system may be exchanged between the crossing module 120 and the vehicle system 140. A positive train control system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a positive train control system may force a train to slow or stop based on the condition of a signal, switch, crossing, or the like that the train is approaching.

As indicated above, in the illustrated embodiment, the crossing determination module 126 is configured to determine an activation time to activate the crossing warning system 110, and to activate or deactivate the crossing warning system 110 based on the presence (or absence) of a vehicle traversing the first route 102 at or near the crossing 170 (e.g., within a specified closing or warning time or distance). Activation of the warning crossing system 110 may include one or more of closing a gate, providing flashing lights, sounding an alarm (e.g., bells), or the like. In various embodiments, the crossing determination module 126 may determine a time to activate (or deactivate) the crossing warning system 110 based on information received from one or more of the vehicle system 140 or the automatic closure module 128.

As one example, timing information including a reference time (configured as an absolute time as discussed herein) may be provided as part of the message 154. The reference time may be specified in some embodiments as a time to activate the warning crossing system 110. In some embodiments, the reference time provided as part of the message 154 may be specified as a time (e.g., an absolute time) when the vehicle system 140 will arrive at the crossing 170. The crossing determination module 126 may then determine a time to activate the crossing 170 based on the reference time (e.g., arrival time). The determination may be made using a predetermined buffer time between the activation of the crossing warning system 110 and the arrival of the vehicle system 140 at the crossing 170. For example, if it is desired that the crossing warning system 110 be activated 20 seconds before the vehicle system 140 arrives at the crossing, then the crossing determination module 126 may determine an activation time to activate the crossing warning system 110 of 20 seconds prior to the arrival time provided via the message 154. As another example, if it is desired that the crossing warning system 110 be activated 30 seconds before the vehicle system 140 arrives at the crossing, then the crossing determination module 126 may determine an activation time of 30 seconds prior to the arrival time.

In the illustrated embodiment, the automatic closure module 128 is configured to impede travel along the second route 160 using information obtained from the track detection system 130. The automatic closure module 128 is operably coupled to and receives information from the track detection system 130, and operates the crossing warning system 110 using information from the track detection system 130. As discussed herein, the track detection system 130 (and/or the automatic closure module 128 in conjunction with the track detection system 130) may be configured to send an electrical signal into a track (e.g., route 102) and receive or detect a signal corresponding to an occupancy or activity on the track. In various embodiments, the automatic closure module 128 may provide redundancy or a back-up to the timing determination module 126.

For example, if the vehicle system 140 is moving at a speed that exceeds the ability of the automatic closure module 128 to activate the warning crossing system 110, the vehicle system 140 may send timing information to the crossing module 120, and the timing determination module 126 may determine a time to activate the warning crossing system 110 before the vehicle system 140 enters the range 104 of the track detection system 130 or automatic closure module 128. However, if the communication module 124 does not receive timing information (or suppression information) from the vehicle system 140, or if the timing determination module 126 receives timing information but is unable to process the received information and activate the crossing warning system 110, then the automatic closure module 128 may operate the closing warning system 110.

As another example, if the vehicle system 140 is moving at a relatively lower speed for which operation of the automatic closure module 128 would result in an overly long time gap between activation and arrival of the vehicle system 140 at the crossing 170, the vehicle system 140 may send suppression information along with the timing information to the crossing module 120. The timing determination module 126 may then determine a time to activate the warning crossing system 110, with the activation time occurring after the vehicle system 140 enters the range 104 of the track detection system 130 or automatic closure module 128, and the crossing module 120 may ignore information from the track detection system 130 and/or suppress a corresponding activation otherwise indicated by the track detection system 130 and/or automatic closure module 128. However, if the communication module 124 does not receive timing information (or suppression information) from the vehicle system 140, or if the timing determination module 126 receives suppression and timing information but is unable to process the received information and activate the crossing warning system 110, then the automatic closure module 128 may operate the closing warning system 110. Further, some vehicles traversing a route (e.g., route 102) may be configured to provide timing and/or suppression information to the crossing module 120, while other vehicles utilizing the same transportation network may not be so equipped. Thus, for example, the automatic closure module 128 and track detection system 130 may be employed in conjunction with vehicles not so equipped, and the timing determination module 126 may be employed in conjunction with vehicles that are so equipped.

As indicated above, in the illustrated embodiment, the automatic closure module 128 is operably coupled with the track detection system 130. Generally, in various embodiments, the automatic closure module 128 works in conjunction with the track detection system 130. The depicted automatic closure module 128 is configured to operate the crossing warning system 110 based on information detected through the route 102. The automatic closure module 128, in conjunction with the track detection system 102 may be configured to close a gate or otherwise initiate a warning as a vehicle approaches the crossing 170 along the first route 102 and/or to open a gate or otherwise terminate a warning after a vehicle has passed through the crossing 170 along the first route 102. In some embodiments, the track detection system 130 may be configured as a crossing predictor system that provides information corresponding to both a position along the route 102 and a speed of the vehicle system 140. In some embodiments, the track detection system 130 may be configured as an occupancy detection system that only provided information regarding whether the vehicle system 140 is present along a given portion of the route 102 or not.

As depicted in FIG. 1, the track detection system 130 has a range 104. In the illustrated embodiment, the track detection system 130 includes a detection element 132 that defines the boundary of the range 104. The detection element 132, for example, may be a shunt buried beneath a track and operably connecting adjacent rails for completing or defining a circuit for a signal sent via a crossing predictor system or directing the signal along a track or rail (e.g., route 102). The range 104 corresponds to the distance at which the track detection system is able to detect or determine the presence of the vehicle system 140. The range 104 defines or corresponds to a reference speed that is the maximum speed at which the vehicle system 140 may travel for which the automatic closure module 128 and/or track detection system 130 is able to detect the vehicle system 140 and activate the warning crossing system in time to meet a standard, mandated, or otherwise desired time for activation before the arrival of the vehicle system 140 at the crossing 170. In FIG. 1, the range 104 is depicted for ease of illustration as extending in one direction (e.g., to the left of the crossing as seen in FIG. 1), but it should be understood that the range 104 may also extend in the opposite direction (e.g., to the right of the crossing as seen in FIG. 1) to provide for traffic detection in multiple directions.

As indicated above, the track detection system may be configured as a crossing predictor system. Crossing predictors may be used to attempt to determine a time of arrival at a crossing by a vehicle. Known crossing predictor systems may use alternating current (AC) track circuits to determine the rate of change of impedance in an area of track near a crossing. The area near the crossing may be referred to as an approach. Such an approach may be hundreds or thousands of feet on either side of a crossing. As a vehicle such as a train moves toward the crossing, the axles of the train act to shunt the AC track circuit signal, shortening the distance that the signal flows through. The crossing predictor (e.g., one or more portions or aspects of the track detection system 130 and/or automatic determination module 128) measures a rate of change of the electrical impedance indicated by the signal, and estimates the speed of location of the train based on the measured electrical impedance, and estimates a predicted arrival time of the vehicle at the crossing based on the determined speed and position, and a crossing warning device may then be activated at a predetermined time interval before the predicted arrival time. Such systems are not without shortcomings, however. For example, such systems may not accurately provide adequate warning time for a vehicle that makes changes in speed after the crossing predictor system detects the vehicle and predicts an arrival time. The crossing warning may be activated too early if the vehicle slows down after the crossing prediction predicts the arrival time, or may be activated too late if the vehicle speeds up after the crossing prediction predicts the arrival time.

Further still, crossing predictor systems do not function properly when a relatively large amount of electrical interference is present, such as electrical interference present in electrified systems. In such electrified systems, vehicles such as trains may be powered by AC or direct current (DC) power provided by an overhead catenary, third rail, or the like. The currents provided to power the vehicles may exceed hundreds or thousands of amperes, and are much larger than currents used by crossing predictor systems. The large difference in signal amplitudes between the electrification currents used to power vehicles and the currents used for crossing predictors may make it difficult to separate the signals when the electrification and predictor currents are shared on the same rail conductors or in close proximity to each other. Further, interference frequencies from the electrification currents may, for example, cause activation via crossing predictors when no vehicles are present, leading to confused motorists and/or motorists evading crossing gates or engaging in other unsafe behavior. Also, in such electrification systems, there may be impedance bonds between adjacent rails configured to balance the flow of electrification currents between rails to improve safety by reducing hazardous voltages that may develop between the rails. Such impedance bonds may cause errors in the impedance calculations used by the crossing predictors used to predict arrival time of vehicles at the crossing. As a result, crossing predictors may not be employed in electrified territories.

Instead, electrified systems may employ occupancy detection circuits or systems. Such occupancy detection track circuits may detect the presence of a train or other vehicle along a route within a given distance of a crossing, but do not detect or determine information corresponding to a more precise position and/or speed of a vehicle. For such systems, a length of approach may be designed to provide the minimum desired or required amount of warning time at the maximum authorized vehicle speed. The length of approach may also be limited by practical considerations, such as the attenuation of a signal along the tracks. By of example, if the maximum authorized speed is 50 miles per hour, and 30 seconds of warning time is desired, than the range (e.g., the distance at which the vehicle is detected) of the track detection system would need to be 2200 feet or longer. (50 miles/hour×1 hour/60 minutes×1 minute/60 seconds×30 seconds×5280 feet/mile=2200 feet.) However, for a train traveling only 25 miles per hour toward the same crossing, the train's presence would be detected (and the crossing warning activated) 60 seconds before the arrival of the train at the crossing, resulting in a warning or closure time twice as long as necessary or desired. Motorists waiting such extended periods of times and/or experiencing such inconsistent warning times may grow impatient and attempt to evade or disregard warnings or closure, resulting in potentially dangerous situations.

Thus, warning times determined by the automatic closure module 128 and track detection system 130 may suffer inconsistency and/or inaccuracy due to a number of causes, depending, for example, on one or more of type of track detection system, delays in messaging, relatively high speed of vehicle approaching crossing, relatively low speed of vehicle approaching crossing, changes in speed of vehicle approaching crossing, or the like. In various embodiments, the crossing module 120 may preferentially select an activation time provided by the crossing determination module 126 using information including timing information configured in terms of an absolute time provided by the vehicle system 140 to an activation time indicated by a crossing predictor system. In various embodiments, the crossing module 120 may operate the warning crossing system 110 in accordance with information received from the vehicle system 140 when information is received from the vehicle system 140, and operate the warning crossing system 110 in accordance with information received from the track detection system 130 when information is not received from the vehicle system 140 (e.g., if communication module of vehicle system or crossing module is not functioning properly, if a given vehicle system is not configured to provide information for operating the warning crossing system, or the like).

The vehicle system 140 is configured to travel along the first route 102. In FIG. 1, the vehicle system 140 is positioned in the territory 106 outside of the range 104 of the track detection system 130, and is traveling in a direction 108 toward the crossing 170. The vehicle system 140 may be, for example, a rail vehicle. In the illustrated embodiment, the vehicle system 140 is depicted as a locomotive, however, the vehicle system 140 may be configured otherwise in other embodiments, for example as a rail vehicle consist, or, as another example, as a non-rail vehicle. In some embodiments, the vehicle system 140 may include an internal source, such as a diesel powered generating unit and/or battery, for providing motive force. In some embodiments, the vehicle system 140 may receive energy for providing motive force from an external power source disposed along the route 102, such as a third rail or overhead catenary. The vehicle system 140 depicted in FIG. 1 includes a processing unit 142, an antenna 150, and a time reference module 152.

The processing unit 142 is configured to be disposed onboard the vehicle system 140, and includes a memory 143, a timing determination module 144, and a communication module 146. It should be noted that FIG. 1 is intended by way of example and is schematic in nature. In various embodiments, various modules (or portions thereof) of the processing unit 142 may be added, omitted, arranged differently, or joined into a common module, various portions of a module or modules may be separated into other modules or submodules and/or be shared with other modules, or the like The timing determination module 144 is configured to determine, based on a speed of the vehicle system 140, timing information corresponding to a time at which the vehicle system 140 will travel proximate the crossing 170. For example, the vehicle system 140 may determine a distance to the crossing 170 based on information received from the crossing module 120 and/or information stored in the memory 143 (e.g., in a database stored in the memory 143). For example, the timing determination module may compare a location as determined by a GPS detector (e.g., time reference module 152) with information regarding the location of the crossing 170 stored in a database of the memory 143 and/or provided via communication with the crossing module 120. Information regarding the speed of the vehicle system 170 in some embodiments may be obtained from a sensor or detector associated with the vehicle system 140, such as a speedometer, tachometer, or the like. In some embodiments, a current speed of the vehicle system 170 obtained from a sensor or detector may be used to estimate an arrival time at the crossing 170 based on the distance to the crossing 170.

Additionally or alternatively, information regarding future speed may also be used to determine a projected arrival time at the crossing. For example, information regarding a current speed and/or future speed along the route 102 may be obtained from a predetermined trip plan and used to calculate a projected time of arrival. Thus, if the vehicle system 140 will be speeding up and/or slowing down between the time of determination of arrival time and the actual arrival time, such changes in speed called for by a trip plan may be used by the timing determination module 144 to determine an estimated time of arrival at the crossing 170. Further, in various embodiments, the arrival time is computed or determined as an absolute time (e.g., a time specified with reference to a high precision synchronization scheme). For example, timing information may be determined using a current time provided by a time reference module 152, with the time provided as an absolute time, with a similarly configured clock available to or associated with the crossing module 120. In various embodiments, the time reference module 152 may provide a time reference, and in other embodiments the time reference module 152 may also process time. Further, in various embodiments, a time reference module may be incorporated into one or more other modules of the transportation system 100. For example, the processing unit 122 of the crossing module 120 may have a time reference module incorporated therein, and the processing unit 142 of the vehicle system 140 may have a time reference module incorporated therein. The processing unit 122 and the processing unit 142 may receive timing information via similar interfaces (e.g., GPS, NTP). In some embodiments, the time reference module 152 may be configured as or include a clock synchronized to a common timing scheme. In some embodiments, time reference module 152 may be a OPS detection unit that provides an absolute time based on a GPS time to the timing determination module 144. The timing determination module 144 may then determine an arrival time by adding the projected time remaining until the vehicle system 140 reaches the crossing to a current time provided by the time reference module 152. In the illustrated embodiment, the timing determination module 144 provides timing information corresponding to an arrival time of the vehicle 140 at the crossing 170 to the communication module 146 for transmission via the antenna 150 to the crossing module 120.

The communication module 146 is configured to communicatively couple the determination module to the crossing module. For example, the communication module 146 may receive timing information from the timing determination module 144, compile and/or format the timing information into a message 154, and transmit the message 154 (via the antenna 150) to the communication module 124 of the crossing module 120 (via the antenna 129). The communication module 146 may be configured to one or more of receive messages (e.g., messages from the crossing module 120), transmit messages, pre-process information or data received in a message, format information or data to form a message, decode a message, decrypt or encrypt a message, compile information to form a message, extract information from a message, or the like. For example, the communication module 146 may be configured to use information from the timing determination module 144 to construct the message 154. In various embodiments, one or more of timing information, track identification information, or suppression information may be formatted into a message along with other message portions, such as a header, address, additional information, or the like. Suppression information, identification information, and timing information may be sent together as one message, or, as another example, may be sent as parts of separate messages.

The timing information provided via the message 154 may be configured as an absolute time. As one example, in various embodiments, the reference time may be a time to initiate a crossing warning activity, such as one or more of closing a gate, activating warning lights, sounding an alarm, or the like. The communication module 146 (and/or timing determination module) may determine the reference warning time by offsetting a projected arrival time by a desired warning time. If 20 seconds of warning are desired to be provided before the vehicle system 140 arrives at the crossing 170, the reference warning time communicated by the communication module 146 may be determined as occurring twenty seconds prior to the estimated, projected, or otherwise determined arrival time. The reference warning time may be configured as an absolute time. As another example, in some embodiments, the reference time may be a projected or estimated time of arrival (configured as an absolute time) of the vehicle system 140 at the crossing 170. The crossing module 120 may use such a reference time of arrival to determine a crossing activation time based on a desired warning time to be provided to vehicles and/or personnel (e.g., motorists) along the second route 160 proximate the crossing 170.

In various embodiments, the communication module 146 may communicate suppression information to the crossing module 120, with the suppression information configured to suppress, prevent, or inhibit the activation of the warning crossing system 110 otherwise called for by the automatic closure module 128 and/or track detection system 130. In one example scenario, the vehicle system 140 may be traveling faster than a reference speed corresponding to the capability of the track detection system 130 and/or the automatic closure module 128. In such a scenario, the automatic closure module 128 and track detection system 130 are not capable of activating the crossing warning system 110 in time to provide a sufficient or desired warning time. Accordingly, timing information from the communication module 146 may be transmitted to the crossing module 120 before the vehicle system 140 enters the range 104 of the track detection system 130 so that the warning crossing system 110 may be activated sufficiently before the vehicle system 140 enters the crossing 170. Because the timing information is sent as an absolute time, additional time to account for messaging delays need not be added, and a consistent warning and/or closure period may be provided.

In another example scenario, the vehicle system 140 is traveling at or about the reference speed corresponding to the capability of the track detection system 130. In such a scenario, if the timing determination module 144 determines that the speed of the vehicle system 140 is a speed that may be handled conveniently by the automatic closure module 128, the vehicle system 140 may be configured to forego sending timing information and rely instead on the automatic closure module 128 to operate the crossing warning system 110. Alternatively, the vehicle system 140 may send the timing information, and the automatic closure module 128 and/or track detection system 130 may be utilized as a back-up or for redundancy in case of any difficulties in the transmission, reception, or comprehension of the timing information. Still further alternatively, in such a scenario, the communication module 146 may provide timing information as well as suppression information to the crossing module. For example, if the vehicle system 140 slows down after entering the range 104, and after the automatic closure module 128 determines a projected arrival time of the vehicle system 140 at the crossing 170, the automatic closure module 128 may activate a warning (e.g., close a gate) earlier than desired. Thus, if the timing determination module 144 determines (e.g., based on information received from a trip plan) that the vehicle system 140 will be slowing substantially after entering the range 104 of the track detection system 130, suppression information configured to suppress the activation otherwise called for by the automatic closure module 128 may be provided to the crossing module 120 before the vehicle system 140 enters the range 104.

In yet another example scenario, the vehicle system 140 is traveling at a relatively slow speed, slower than the reference speed corresponding to the capability of the track detection system 130. Thus, for example, if the track detection system 130 is an occupancy detection system, the automatic closure module 128 may initiate a warning activity upon entry of the vehicle system 140 into the range 104, resulting in an overly long closure or warning time. To help prevent the overly long closure or warning time, in various embodiments the communication module 146 of the vehicle system 140 may transmit a message or messages (e.g., message 154) to the crossing module include both timing information corresponding to an activation time of the crossing warning system 110 based on the projected arrival time of the vehicle system 140 at the crossing 170, as well as suppression information configured to suppress, impede, prevent, or inhibit operation of the crossing warning system 110 otherwise called for by the automatic closure module 128 and the track detection system 130. Such information may be sent before the vehicle system 140 enters the range 104 to help prevent premature activation of the crossing warning system 110 as well as to help prevent gate pump (e.g., lowering and raising of a gate caused by conflicting or inconsistent activations called for by the timing determination module 126 and the automatic closure module 128).

Further still, in various embodiments, the communication module 146 may be configured to transmit track or sub-route identification information to the crossing module. For example, in some areas, a transportation network may include multiple adjacent sub-routes or separate tracks, such that vehicle systems may travel generally parallel to each other. Thus, multiple adjacent sub-routes of a route 102 may each cross a second route (e.g., second route 160) at the same crossing 170. In such embodiments, a given crossing module 120 and/or crossing warning system 110 may be configured to provide a warning based on traffic along multiple sub-routes. Track identification information may be utilized by such a crossing module 120 to ensure that automatic closure activities are only suppressed for a particular track upon which a vehicle sending suppression information is disposed. (See also FIG. 2 and related discussion.)

For instance, in one example scenario, the route 102 may comprise plural sub-routes (e.g., tracks running parallel to each other through the crossing 170, with each sub-route configured to accommodate travel by a vehicle when the other sub-routes are occupied with other vehicles). The suppression information may include sub-route identification information corresponding to particular sub-route on which the vehicle system 140 is traveling. For instance, the route 102 may include tracks A, B, and C, with B identified as the sub-route or track upon which the vehicle system 140 is traveling. The identification information may be determined based on information provided at the outset of the mission and/or periodically updated as the vehicle system 140 performs a mission. With the suppression information identified as corresponding to track B, if the automatic closure module 128 detects a vehicle on either of tracks A or C instead of track B, the automatic closure module 128 may operate the crossing warning system 110 to activate a warning (for example, the crossing module 120 may override the suppression information associated with a different track, or, as another example, the crossing module 120 may ignore the suppression information associated with a different track). In various embodiments, the crossing module may receive timing information and/or detect the presence of vehicles along multiple sub-routes or tracks, and be configured to select the most restrictive warning activity (e.g., the earliest occurring warning activity) from among plural warning initiations called for by the various messages or detected activity.

Thus, as discussed herein, various embodiments provide for more consistent warning times at crossings, and/or reduce delay, inconvenience and/or confusion caused by overly long warning periods. Various embodiments provide for improved consistency of warning time in electrified territory where crossing predictors may not be used. Further, various embodiments provide for improved consistency of warning time at relatively slow vehicle speeds, and/or when vehicle speeds are anticipated to change proximate to a crossing.

Figure 2:
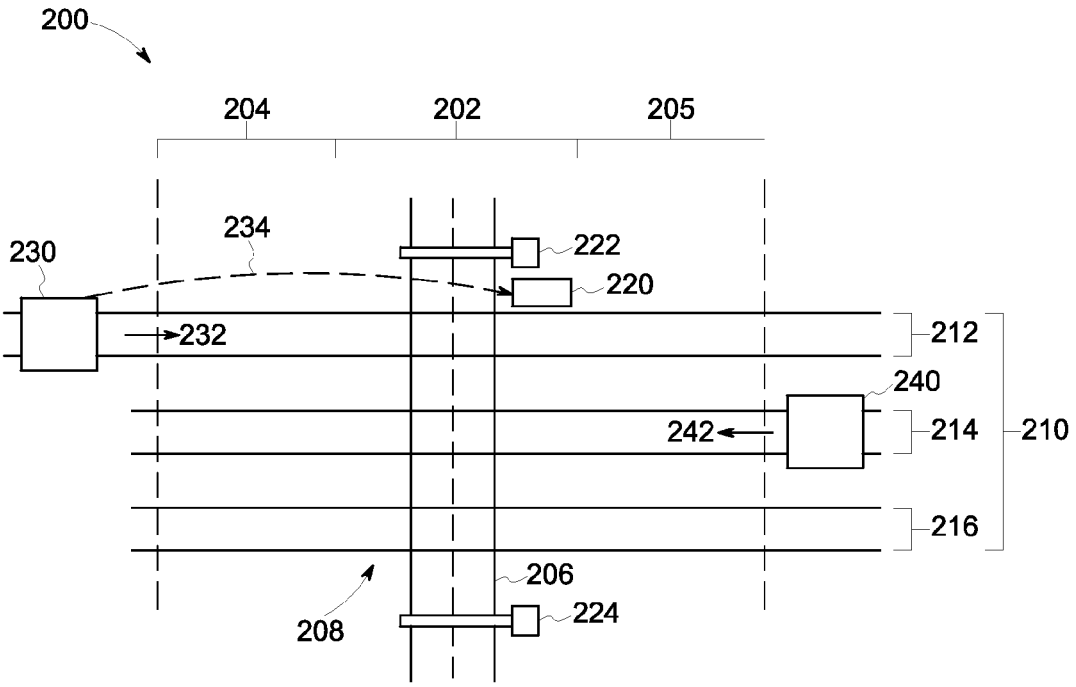
FIG. 2 is an overhead schematic diagram of a transportation network in accordance with an embodiment.

FIG. 2 provides an overhead schematic diagram of an embodiment of a transportation network 200 formed in accordance with an embodiment. The transportation network 200 is configured to utilize timing information including suppression information and track identification information to provide constant warning times utilizing messages from vehicles approaching a crossing, as well as to utilize automatic initiation of a warning based on information from a track detection system or circuit when appropriate. The transportation network 200 includes a first route 210 that includes generally parallel sub-routes 212, 214, 216. In the illustrated embodiment, each sub-route may be configured as a pair of tracks or rails configured for travel by a rail vehicle. In FIG. 2, a first rail vehicle 230 traverses the track 212 in a direction 232, and a second rail vehicle 240 traverses the track in a direction 242. The rail vehicles 230, 240 may each be configured as, for example, a rail vehicle consist or another vehicle capable of self-propulsion. In various embodiments, the rail vehicles 230, 240 may receive power from a power source (not shown)

disposed along the first route 210, such as a third rail or overhead catenary. Each of the depicted sub-routes or tracks 212, 214, 216 intersect a second route 206 at a crossing 208. The transportation network 200 also includes crossing gates 222, 224 positioned on either side of the first route 210 along the second route 206. The crossing gates 222, 224 are configured to impede traffic along the second route 206 through the crossing 208 when activated. The transportation network 200 further includes a crossing module 220 configured to operate the crossing gate 222 and the crossing gate 224.

The network 200 also includes an island 202 interposed between approaches 204, 205. The island 202 corresponds to an area for which the crossing gates 222, 224 are configured to be closed whenever a vehicle is present along the first route 102, regardless of whether the vehicle is moving or not. The approaches 204, 205 define areas within the range of a track detection system utilized by the crossing module 220.

The crossing module 220 may determine when to activate (or de-activate) a warning crossing in certain respects generally similar to the discussion herein regarding the embodiment depicted in FIG. 1. For example, the crossing module 220 may operate the crossing gates 222, 224 responsive to information received from a vehicle (e.g., rail vehicle 230) and/or responsive to information received from a track detection system (e.g., track detection system 130 discussed in conjunction with FIG. 1).

An example scenario illustrating the use of suppression and track identification information will now be discussed in connection with FIG. 2. In the example scenario, the rail vehicle 230 is traveling toward the crossing 208 along the track 212 of the first route 102. The rail vehicle 230 is outside of the approach 204 and therefore beyond the range of the automatic closure module of the crossing module 220. The rail vehicle 240 is traveling toward the crossing 208 along the track 214 of the first route 102. The rail vehicle 240 is outside of the approach 205 and also beyond the range of the automatic closure module of the crossing module 220. In the example scenario, the rail vehicle 240 is traveling at a higher rate of speed than the rail vehicle 230. The rail vehicle 230 is traveling at a speed lower than a reference speed corresponding to the ability of the crossing module 220 to activate the crossing gates 222, 224 using information from a track detection system, while the rail vehicle 240 is traveling at or about at the reference speed.

The rail vehicle 230 is configured to send timing information to the crossing module 220 in the example scenario; however, the rail vehicle 240 is not (e.g., an antenna and/or communication module of the rail vehicle 240 may be damaged, the rail vehicle 240 may be an older model, or the like). In the illustrated embodiment, the rail vehicle 230 sends a message 234 to the crossing module. The message 234 includes timing information corresponding to a time when the rail vehicle 230 will enter the crossing 208. The crossing module 220 is configured to determine a time to activate (e.g., lower) the crossing gates 222, 224 based on the timing information. Further, as the rail vehicle 230 is traveling slower than the reference speed, the message 234 includes suppression information to prevent an otherwise automatic activation of the crossing gates 222, 224 when the rail vehicle 230 enters the approach 204.

Further still, the message 234 includes track identification information identifying track 212 as the sub-route upon which the rail vehicle 230 is traveling. For example, the track identification information may be obtained by the rail vehicle 230 using one or more of manually input information, information from switches the rail vehicle 230 has passed over, location determination systems utilizing OPS, RFID tags, or the like. The rail vehicle 230 may also utilize an onboard database describing or depicting the layout of the transportation network 200 or portions thereof. The crossing module 220 is configured to use the track identification information to suppress automatic activation of the crossing gates 222, 224 only for track 212, and not for other tracks or sub-routes. Thus, if a different vehicle approaches on a different track, the crossing gates 222, 224 may be activated as appropriate based on the other vehicle's position.

For example, in the illustrated embodiment, as the rail vehicle 240 enters the approach 205, the crossing module 220 is configured to identify the rail vehicle as traveling on a different track (e.g., track 214) than the track 212 for which suppression information corresponding to the rail vehicle 230 has been received. Thus, the crossing module 220 may override or ignore the suppression information to activate the crossing gates 222, 224, avoiding a dangerous situation where the rail vehicle 240 may have passed through the crossing 208 without the crossing gates 222, 224 being activated.

Figure 3:
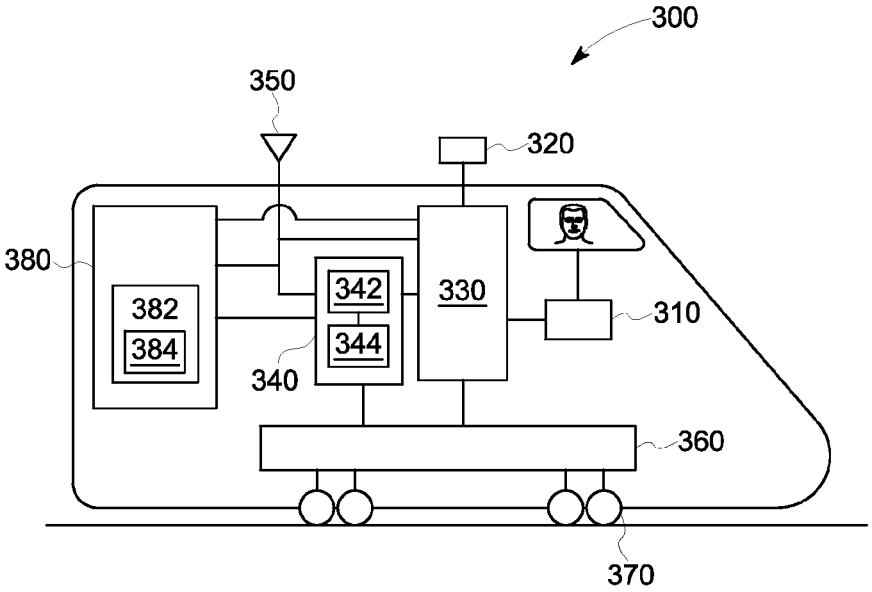
FIG. 3 is a schematic view of a vehicle system in accordance with an embodiment.

FIG. 3 provides a schematic view of a vehicle system 300 formed in accordance with an embodiment. The vehicle system 300 may include, for example, a rail vehicle consist including rail vehicle units (e.g., locomotives and non-powered units). The vehicle system 300 of the illustrated embodiment includes a manual input module 310, an automatic input module 320, a control module 330, a trip planning control module 340, an antenna 350, a propulsion system 360, wheels 370, and a timing determination module 380. Generally speaking, in the depicted embodiment, the trip planning control module 340 is configured to plan a trip and to provide control messages, either to an operator and/or directly to the propulsion system 360, to propel the vehicle system 300 along a trip or mission. The propulsion system 360 may include one or more motors and one or more brakes, with the control messages configured to cause the propulsion system to engage in braking or motoring activities in accordance with a trip plan. The automatic control system 330 may be configured to operate in accordance with a PTC system. In the illustrated embodiment, the automatic control system 330 is configured to override the trip planning control module 340 and/or an operator control, for example, to stop or slow the vehicle system 300 in accordance with a rule, for example a speed limit, or a safety condition such as a lockout or circumstance where another vehicle occupies a segment of a route the vehicle system 300 would otherwise enter pursuant to a command by the trip planning control module 340 and/or operator control. The antenna 350 is configured for communication between the vehicle system 300 and one or more off-board systems, such as, for example, wayside stations (e.g., crossing module 120, 220) and/or central scheduling systems and/or other vehicles traversing a transportation network. The rail vehicle system 300 is depicted as a single powered rail vehicle unit for ease of depiction. Other vehicle systems, including rail vehicle consists, may be employed in other embodiments.

The manual input module 310 is configured to obtain manually input information including manually input location information. The manually input location information may be used alone or in conjunction with automatically input location information by the timing determination module 380 to determine track identification information for the rail vehicle system 300. The manually input information may correspond to information obtained via operator observation from one or more sources. For example, the manually input information may be obtained from a sign or other object configured to convey position information and mounted, hung, or otherwise disposed proximate to a track or route.

The automatic input module 320 is configured to automatically obtain (e.g., without operator intervention) location information and/or timing information. The automatically obtained information may correspond to a particular route or track (e.g., automatically obtained information may describe a change in particular track being traversed due to the activation of a switch); a location along a track or route (e.g., information from a GPS detector giving a geographic position or identifying a segment of a track or route where the vehicle system 300 is located); and/or a direction (e.g. information from a GPS detector taken at different times with the vehicle system 300 in motion used to determine a trend or direction). The automatic input module 320 in the illustrated embodiment is also configured to provide absolute time information to be utilized by the timing determination module 380. For example, the automatic input module may include timing information from a GPS system or other system synchronized to a common time reference as one or more crossing modules. Automatically obtained information may also include speed information used by the timing determination module to determine a projected time of arrival at a crossing. Thus, the vehicle system 300 may include one or more of a GPS detector, an axle tachometer, inertial system, LORAN system, or the like. Further, the automatic input module may include a receiver configured to receive location information from a transponder associated with a track or route on which the vehicle system 300 is disposed, for example a transponder associated with a wayside station, a switch, and/or a signal. For example, a message associated with a switch may provide information regarding a change from one track or route to another due to a position of the switch, or a message from a wayside station may include information corresponding to a vehicle's position along a route or track based on the location of the wayside station.

In the illustrated embodiment, the automatic control module 330 is configured to control the vehicle system 300 to conform to a set of regulations along a route during a trip or mission performed by the vehicle system 300. The automatic control module 330 may be configured to control the vehicle system 300 pursuant to a PTC system. The regulations may be location-based regulations. The regulations may be based on a rule or requirement of operation for a particular route segment, such as a speed limit or the like. The regulations may also correspond to a condition of a track or related componentry, such as if a route segment is occupied by a different vehicle, if a switch is misaligned, or the like. The automatic control module 330 may use location information provided by the manual input module 310 and the automatic input module 320 to determine appropriate automatic control activities. The automatic control module 330, when enabled, may override or interrupt a previously planned controlled activity (e.g., a control activity previously determined by the trip planning control module 340) and/or an operator controlled activity.

The trip planning control module 340 of the vehicle system 300 may be configured to receive a schedule sent by an off-board scheduling system. The trip planning control module 340 may include a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as a memory 344. The memory 344 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

The trip planning control module 340 may include one or more modules that perform various operations. The control module 342, along with other modules (not shown) may be included in the controller. The modules may include hardware and/or software systems that operate to perform one or more functions, such as the controller and one or more sets of instructions. Alternatively, one or more of the modules may include a controller that is separate from the controller, or may be combined to form a combined module.

The trip planning control module 340 may receive a schedule from a scheduling system. The trip planning control module 340 may be operatively coupled with, for example, the antenna 350 to receive an initial and/or modified schedule from the scheduling system. In an embodiment, the schedules are conveyed to the control module 342 of the trip planning control module 340. In an embodiment, the control module 342 may be disposed off-board the vehicle system 300 for which the trip plan is formed. For example, the control module 342 may be disposed in a central dispatch or other office that generates the trip plans for one or more vehicles.

In the illustrated embodiment, the control module 342 receives the schedule sent from the scheduling system and generates a trip plan based on the schedule. The trip plan may include throttle settings, brake settings, designated speeds, or the like, of the vehicle system 300 for various sections of a scheduled trip or mission of the vehicle system 300 to the scheduled destination location. The trip plan may be generated to reduce the amount of fuel that is consumed by the vehicle system 300 and/or the amount of emissions generated by the vehicle system 300 as the vehicle system 300 travels to the destination location relative to travel by the vehicle system 300 to the destination location when not abiding by the trip plan. Optionally, controlling the vehicle system 300 according to the trip plan may result in the vehicle system 300 consuming less fuel and/or generating fewer emissions to reach a destination location than if the same vehicle system 300 traveled along the same routes to arrive at the same destination location at the same time as the trip plan (or within a relatively small time buffer, such as one to three or five percent of the total trip time, or another relatively small percentage), but traveling at speed limits (e.g., track speed) of the routes.

In order to generate the trip plan for the vehicle system 300, the control module 342 can refer to a trip profile that includes information related to the vehicle system 300, information related to a route over which the vehicle system 300 travels to arrive at the scheduled destination, and/or other information related to travel of the vehicle system 300 to the scheduled destination location at the scheduled arrival time. The information related to the vehicle system 300 may include information regarding the fuel efficiency of the vehicle system 300 (e.g., how much fuel is consumed by the vehicle system 300 to traverse different sections of a route), the tractive power (e.g., horsepower) of the vehicle system 300, the weight or mass of the vehicle system 300 and/or cargo, the length and/or other size of the vehicle system 300, the location of powered units in the vehicle system 300, or other information. The information related to the route to be traversed by the vehicle system 300 can include the shape (e.g., curvature), incline, decline, and the like, of various sections of the route, the existence and/or location of known slow orders or damaged sections of the route, and the like. Other information can include information that impacts the fuel efficiency of the vehicle system 300, such as atmospheric pressure, temperature, and the like.

The trip plan is formulated by the control module 342 based on the trip profile. For example, if the trip profile requires the vehicle system 300 to traverse a steep incline and the trip profile indicates that the vehicle system 300 is carrying significantly heavy cargo, then the control module 342 may form a trip plan that includes or dictates increased tractive efforts for that segment of the trip to be provided by the propulsion subsystem 360 of the vehicle system 300. Conversely, if the vehicle system 300 is carrying a smaller cargo load and/or is to travel down a decline in the route based on the trip profile, then the control module 342 may form a trip plan that includes or dictates decreased tractive efforts by the propulsion subsystem 350 for that segment of the trip. In an embodiment, the control module 342 includes a software application or system such as the Trip Optimizer™ system provided by General Electric Company. The control module 342 may directly control the propulsion system 360 and/or may provide prompts to an operator for control of the propulsion system 360. As discussed above, control activities planned by the trip planning control module 340 may be overridden by control activities called for by the automatic control module 330.

The timing determination module 380 may include a memory 382 including a database 384. The timing determination module 380 is configured to determine an estimated or projected time of arrival of the rail vehicle system 300 at an upcoming crossing and to communicate timing information corresponding to the arrival at the crossing to a crossing module associated with the crossing. For example, the timing determination module 380 may determine a distance to a crossing. The timing determination module 380 may obtain location information describing or corresponding to a position along a route of the rail vehicle system 300 from the automatic input module 320. The timing determination module 380 may then determine a distance from the rail vehicle system 300 to a given crossing using, as one example, information from a crossing module describing or corresponding to the location of the crossing received via antenna 350, or as another example, information from the database 384 describing or corresponding to the location of the crossing.

The timing determination module 380 may further obtain speed information corresponding to the current and/or future speed of the vehicle system 300. For example, a current speed may be obtained from the automatic input module 320 (e.g., axle tachometer, change in GPS position, speedometer, or the like). The current speed, along with the distance to the crossing, may be used to determine an estimated or projected time of arrival. Additionally or alternatively, a current and/or future speed (or speeds) may be obtained from the trip planning control module 340. Trip plan information describing or corresponding to the upcoming speed of the rail vehicle system 300 before the rail vehicle system 300 arrives at the crossing may be used to determine arrival time (e.g., if speed is going to change between determination time and arrival time). For example, if the rail vehicle system 300 is going to slow down between the time of determining an arrival time and arrival, the arrival time may be determined to occur an appropriate amount of time later than if determined using the current speed. As another example, if the rail vehicle system 300 is going to speed up between the time of determining an arrival time and arrival, the arrival time may be determined to occur an appropriate amount of time earlier than if determined using the current speed. If the speed deviates from the speed called for by the trip plan after the timing information is transmitted to a crossing module, the arrival time may be re-determined and a subsequent message sent to the crossing module.

Figure 4:
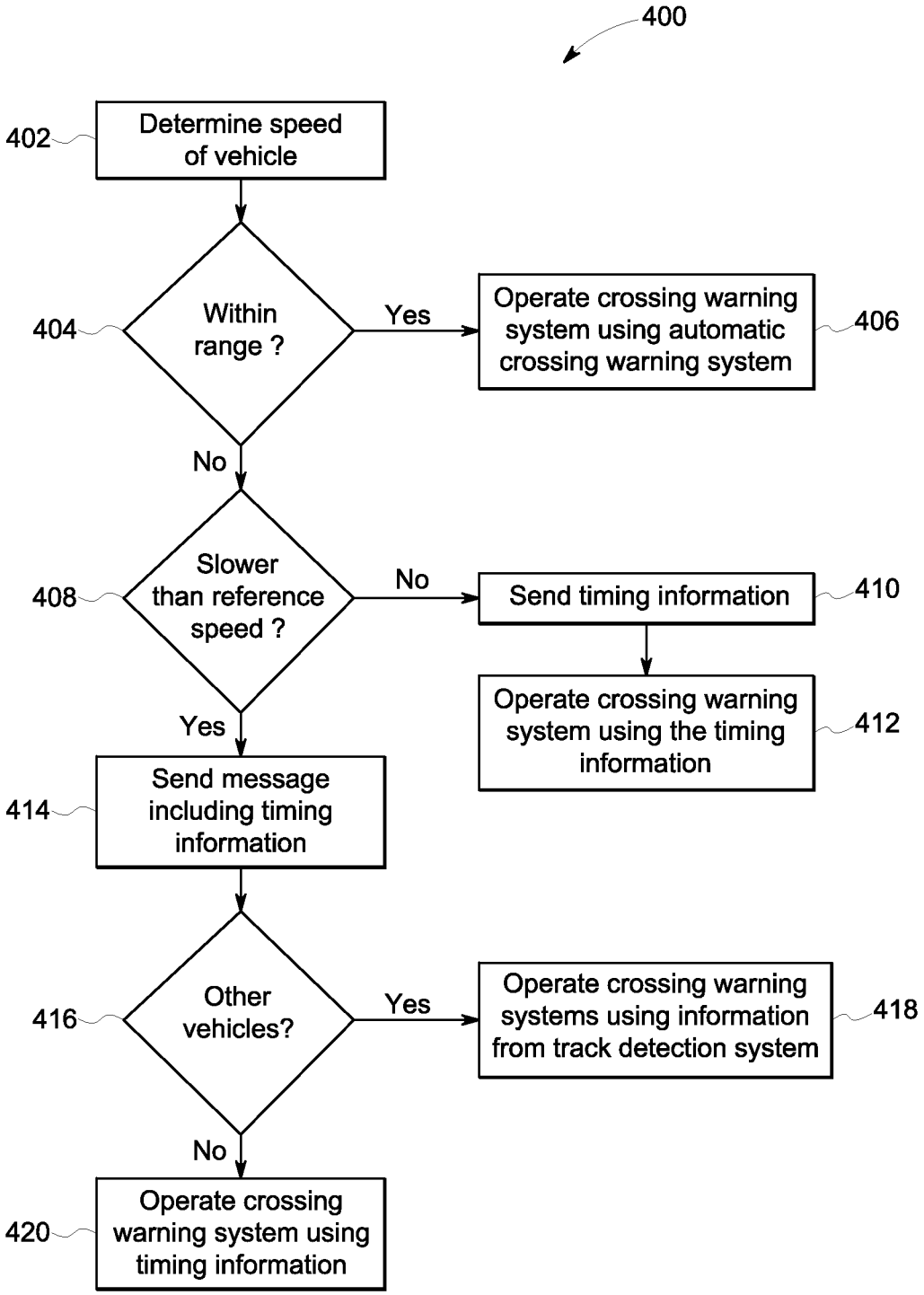
FIG. 4 is a flowchart of an embodiment for operating a crossing.

FIG. 4 is a flowchart of an embodiment of a method 400 for determining a warning time (e.g., closing time) for a crossing. The method 400 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 402, the speed of a vehicle (e.g., a rail vehicle) traversing a first route is determined as the vehicle approaches a crossing. The speed may be determined onboard a vehicle traversing a route (e.g., timing determination module 144). In various embodiments the speed may be determined based on a measured speed and/or a speed called for by a trip plan or other control scheme.

At 404, it is determined if the speed of the vehicle lies within a predetermined range of a reference speed of an automatic crossing warning system. The automatic crossing warning system may include a track detection system (e.g., track detection system 130) and/or an automatic detection module (e.g., automatic closure module 128). In some embodiments, the determination of whether or not the speed lies within the predetermined range of the reference speed of the automatic crossing system may be made onboard a vehicle (e.g., at the timing determination module 144). The reference speed may be understood as the speed at which a vehicle can be traveling for which the automatic closure module can detect the vehicle and close the crossing in time to meet a standard time for closing before arrival of the vehicle at the crossing. The automatic crossing warning system may be configured to impede travel (e.g., by closing gates, activating lights, sounding alarms, or the like) along a second route that intersects the first route at the crossing. If the speed of the vehicle is within the predetermined range of the reference speed automatic crossing warning system, the method proceeds to step 406, but if the speed of the vehicle is outside of the predetermined range (e.g., more than a specified amount below the reference speed or more than a specified amount above the reference speed), the method proceeds to step 408.

At 406, the automatic crossing warning system is utilized to operate a crossing warning system (e.g., lowering a gate). In some embodiments, the crossing warning system may be operated according to information obtained from a crossing predictor system as discussed herein. It should be noted than in alternate embodiments, steps 404 and 406 may be omitted and timing information may be transmitted from the vehicle regardless of vehicle speed. In various embodiments, an automatic crossing warning system may be used as back-up for timing information sent by an approaching vehicle, and/or may be used with older vehicles not configured to transmit timing information as discussed herein.

At 408, it is determined if the current (or expected) speed of the vehicle is slower than the reference speed. If the speed is not slower than the reference speed (e.g., the speed is higher than the reference speed), the method proceeds to step 410. If the speed is lower than the reference speed, the method proceeds to 414.

At 410, timing information is sent from the vehicle (e.g., from the communication module 146 via antenna 150) to a crossing module. The timing information is transmitted before the vehicle enters a range of a track detection system associated with the crossing, and includes a reference time configured as an absolute time. In some embodiments, the reference time may be an estimated time of arrival of the vehicle at the crossing. In some embodiments, the reference time may be a time to activate a crossing warning system.

At 412, a crossing warning is activated (e.g., a gate lowered or the like) using the timing information. For example, a warning determination module disposed onboard a crossing module may determine an activation time using a reference time included in the timing information, and operate the crossing warning in accordance with the determined activation time. For example, if the reference time is a time of arrival, the warning determination module may determine an activation time a predetermined amount of time before the arrival time, and activate the crossing warning at the activation time.

At 414, with the speed slower than the reference speed, a message including timing information is transmitted from the vehicle to a crossing module. The message or timing information may also include suppression information and track identification information. The crossing module is configured to prevent an otherwise called for activation of a crossing warning called for by information received from a track detection system responsive to the suppression information. The track identification information identifies a track upon which the vehicle is traveling, and is used by the crossing module to over-ride or ignore the suppression information when a different vehicle is detected on a different track.

At 416, it is determined if one or more other vehicles are approaching the crossing on a different track than the track on which the vehicle that sent the timing information is approaching. For example, a track detection system may be employed to determine if any other vehicles are approaching on any other tracks. If other vehicles are detected, the method proceeds to step 418. If no other vehicles are detected, the method proceeds to step 420. Additionally, in various embodiments, if it is determined (e.g., by the onboard processing unit 142) that the route up to the crossing is not clear (for example, if the vehicle is following another vehicle or vehicles that may not be equipped with PTC) suppression information may not be sent to the crossing module.

At 418, a crossing warning is activated based on information received from the track detection system indicating the presence or approach of a vehicle not associated with previously transmitted suppression information. At 420, suppression is continued as the vehicle which transmitted the suppression information enters the range of the track detections system. The crossing warning is instead activated (e.g., a gate lowered or the like) using the timing information transmitted from the vehicle. For example, a warning determination module disposed onboard a crossing module may determine an activation time using a reference time included in the timing information, and operate the crossing warning in accordance with the determined activation time. For example, if the reference time is a time of arrival, the warning determination module may determine an activation time a predetermined amount of time before the arrival time, and activate the crossing warning at the activation time.

Figure 5:
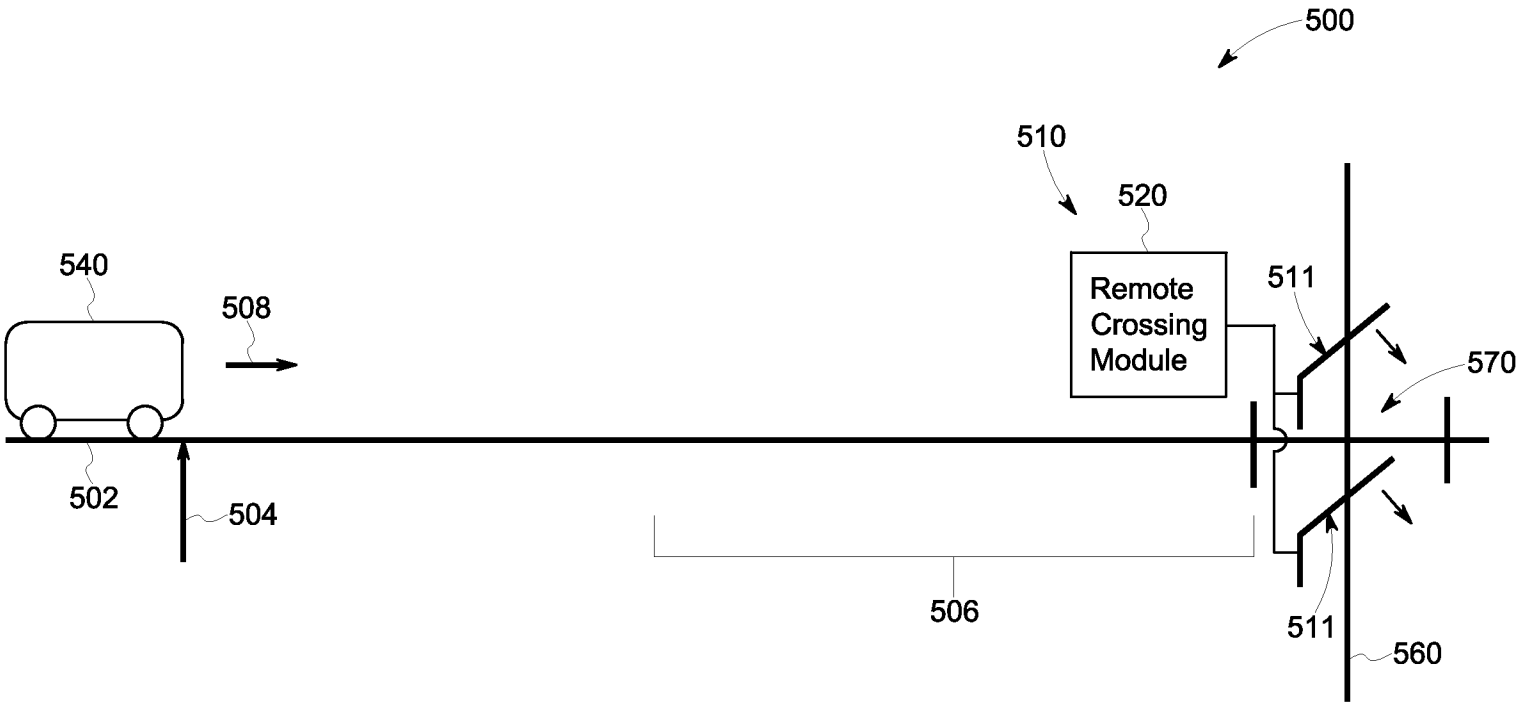
FIG. 5 illustrates a schematic view of a transportation system in accordance with an embodiment.

FIG. 5 illustrates a schematic view of a transportation system 500 in accordance with an embodiment. The transportation system 500 may represent or be similar to the transportation system 100 shown in FIG. 1. A crossing warning system 510 includes a crossing module 520. The crossing warning system 510 may represent or be similar to the crossing warning system 110 (shown in FIG. 1) and the crossing module 520 may represent or be similar to the module 120 (shown in FIG. 1). A vehicle system 540 (e.g., the vehicle system 140 shown in FIG. 1) travels along a first route 502 (e.g., the route 102 shown in FIG. 1) in a direction of travel 508 toward a crossing 570. The crossing 570 represents an intersection of the first route 502 and a second route 560. The routes 502, 560, for example, may be roads, paths, rails, tracks, or the like. The crossing warning system 510 and the crossing module 520 are associated with and disposed proximate the crossing 570. The crossing warning system 510 and the crossing module 520 are configured to impede (e.g., prevent) access through the crossing 570 via the second route 560 when the vehicle system 540 passes by or through the crossing 570 along the first route 502.

The vehicle system 540 and crossing warning system 510 communicate so as to wirelessly activate the crossing warning system 510 to prevent passage of vehicles through the crossing 570 when the vehicle system 540 travels through the crossing 570. Although not shown in FIG. 5, the vehicle system 540 and crossing warning system 510 may include wireless communication components, such as antennas, transceivers, transceiver circuitry and/or software, and the like, that permit the vehicle system 540 and the crossing warning system 510 to wirelessly communicate. Optionally, the vehicle system 540 and the crossing warning system 510 may communicate with each other via one or more wired connections, such as a conductive pathway extending along the route 502 (e.g., a rail, wire, bus, catenary, or the like).

As described above, the vehicle system 540 may communicate a notification message to the crossing module 520 to notify the crossing module 520 when the vehicle system 540 will arrive at and/or pass through the crossing 570. The notification message can include an arrival time that is calculated by the vehicle system 540 and that represents when the vehicle system 540 expects to be at the crossing 570. As described above, some vehicles may include a buffer time in calculating the arrival time in order to allow for the vehicles to accelerate between the time when the modification message is transmitted to the crossing module 520 and the time that the vehicle system 540 actually arrives at the crossing 570.

In an embodiment of the systems 510, this buffer time is not included in the calculation of the arrival time. In order to allow for the vehicle system 540 to accelerate between the time when the arrival time is transmitted by the vehicle system 540 and the time that the vehicle system 540 actually arrives at the crossing 570, but without including the buffer time in the calculation of the arrival time, the vehicle system 540 may repeatedly transmit the arrival time (without the built-in buffer time) to the crossing module 520. Repeatedly broadcasting the notification message with the arrival time that does not include the buffer time allows the crossing module 520 to determine when to activate one or more warning devices 511 (shown as gates, but optionally could include audible warnings, visible warnings, and/or other physical barriers). The vehicle system 540 can accelerate after sending one or more of the notification messages, subject to limitations on one or more speed restrictions on the route 502 and/or speed restrictions following a failure in communication between the vehicle system 540 and the crossing module 520. For example, the vehicle system 540 may be automatically and/or manually prohibited from traveling faster than a designated speed limit following the inability of the vehicle system 540 to communicate with the crossing module 520.

In operation, the vehicle system 540 travels along the route 502 in the direction of travel 508. In response to the vehicle system 540 reaching or passing a notification location 504 along the route 502, the vehicle system 540 communicates (e.g., transmits or broadcasts) the notification message to the crossing module 520. The notification location 504 can be a location that is identified or determined while the vehicle system 540 is traveling toward the crossing 570. The vehicle system 540 may determine that it has arrived at or passed the notification location 504 using signals received by an antenna (e.g., the antenna 350 shown in FIG. 3, such as a GPS receiver or other wireless receiver), an RFID receiver or transponder, or the like. Optionally, the operator may manually identify the notification location 504 by manually instituting the communication of the notification message from the vehicle system 540.

The notification location 504 may not be a fixed point or location. For example, the notification location 504 for the different vehicles may be different when these vehicles travel along the same route 502 toward the same crossing 570. Optionally, the operator of the vehicle system 540 may manually select the notification location 504 by initiating communication of the notification message. In one aspect, the notification location 504 may be a fixed or designated location along the route 502, such as a location that is sufficiently far from the crossing 570 that, even if the vehicle system 540 travels at the speed limit of the route 502, the vehicle system 540 will not reach the crossing 570 before the notification message is received by the crossing module 520 and the crossing module 520 activates the warning devices 511. The vehicle system 540 may not begin communication of the notification message to the crossing module 520 for the vehicle system 540 to pass through the crossing 570 having the warning devices 511 that are controlled by the crossing module 520 unless and until the vehicle system 540 reaches and/or passes the notification location 504.

Once the vehicle system 540 reaches the notification location 504, the vehicle system 540 begins to repeatedly communicate (e.g., broadcast or transmit) a calculated arrival time of the vehicle system 540 at the crossing 570. The arrival time may be calculated using a timing determination module, such as the timing determination module 380 shown in FIG. 3. As described above, the arrival time that is calculated and communicated may not include any additional buffer time to allow for changes (e.g., acceleration) of the vehicle system 540.

The timing determination module 380 can determine the calculated arrival time using the actual speed of the vehicle system 540 and the current distance between the vehicle system 540 and the crossing 570. For example, the arrival time may be calculated by multiplying the distance to be traveled by the vehicle system 540 from a current location to the crossing 570 (which may not be a straight line distance due to curvatures and/or undulations in the route 502) by the current speed of the vehicle system 540. Optionally, the arrival time may be obtained from a trip plan being followed by the vehicle system 540. For example, the trip plan may designate operational settings (e.g., speeds, throttle settings, brake settings, and the like) as a function of time and/or distance along the route 502 of the vehicle system 540 for traveling at least to the crossing 570. The timing determination module can examine these designated operational settings and calculate or estimate the arrival time of the vehicle system 540 at the crossing 570 if the vehicle system 540 travels according to the operational settings designated by the trip plan.

In one aspect, the timing determination module of the vehicle system 540 calculates a departure time of the vehicle system 540 from the crossing 570. The departure time also may be referred to a as "time to clear" the crossing 570, and represents the time at which the vehicle system 540 is calculated to have completely passed through the crossing 570. For example, the departure time may represent the time at which the back or trailing end of the vehicle system 540 along the direction of travel 508 is calculated to have completed travel through the crossing 570 along the direction of travel 508. The departure time may be calculated or determined in a manner similar to the arrival time, with the exception that the location of the back or trailing end of the vehicle system 540 is taken into account The vehicle system 540 may communicate both the calculated arrival time of the vehicle system 540 at the crossing 570 (e.g., the time at which the front or leading end of the vehicle system 540 along the direction of travel 508 is calculated to be at the crossing 570) and the departure time of the vehicle system 540 in the notification message. One or both of the arrival and departure times may be communicated as absolute times. Optionally, one or both of the arrival and/or departure times may additionally or alternatively may be communicated as relative times.

The vehicle system 540 repeatedly communicates the notification message to the crossing module 520. The vehicle system 540 can re-transmit or re-broadcast the notification message at a relatively fast rate. By way of example, the vehicle system 540 can re-send the notification message to the crossing module 520 at least once very second. The rate at which the notification message is sent by the vehicle system 540 may be referred to as a re-transmission rate, even if the vehicle system 540 is broadcasting rather than transmitting the notification message. Optionally, the vehicle system 540 may repeatedly send the notification message and one or more off-board repeater devices (e.g., wireless devices that receive the notification message from the vehicle system 540 and relay or repeat the notification message to the crossing module 520) may repeatedly send the notification message.

The crossing module 520 receives the notification messages with the calculated arrival times and/or departure times. The crossing module 520 can confirm receipt of one or more, or all, of the notification messages that are received by communicating an acknowledgement message to the vehicle 540. The crossing module 520 may store (e.g., in an internal or external memory) the arrival time and/or departure time of the vehicle 540. These stored arrival and/or departure times can be replaced when subsequent notification messages are received. For example, if a subsequent notification message includes a different arrival time and/or departure time than a stored arrival and/or departure time from a previously received notification message, then the crossing module 520 may update (e.g., replace) the stored arrival and/or departure times with the subsequently received arrival and/or departure times.

The arrival and/or departure times may change as the vehicle system 540 travels toward the crossing 570 due to changes in speed and/or the trip plan of the vehicle system 540. For example, the vehicle system 540 may slow down, speed up, modify the trip plan, switch between manual and automatic control (or vice-versa), or the like, following transmission of an earlier notification message. These changes can delay or speed up the arrival time and/or departure time. By updating the arrival time and/or departure time of the vehicle system 540 to the more or most recently received notification message, the crossing module 520 can ensure that the crossing module 520 has a more current or accurate arrival and/or departure time. For example, as the distance between the vehicle system 540 and the crossing 570 closes (e.g., becomes less), there is less room for the vehicle system 540 to significantly alter speed and/or acceleration. Therefore, the arrival times and/or departure times of the notification messages received when the vehicle system 540 is closer to the crossing 570 may more accurately reflect the actual arrival and/or departure times of the vehicle system 540.

A communication delay may exist between the vehicle system 540 sending a notification message and the vehicle system 540 receiving the acknowledgement message from the crossing module 520. Some previously known systems included the buffer time into the calculated arrival time in order to account for this communication delay. Because the notification messages are communicated repeatedly and/or at relatively fast rates in an embodiment described herein, however, this buffer time does not need to be included in the calculated arrival time and/or departure time. In an aspect relating to rail vehicle consists as the vehicle system 540, the vehicle system 540 may accelerate (and/or decelerate) relatively slowly relative to the relatively rapid repeated communication of the notification messages, thereby further reducing the need for inclusion of the buffer time in the arrival time and/or departure time.

The crossing module 520 monitors the arrival time of the vehicle system 540 and activates the warning devices 511 once the arrival time is as soon as, or sooner than, a designated warning time. The crossing module 520 may be associated with a designated warning time representative of a lower (e.g., minimum or other) time period within which the warning devices 511 are to be activated. This warning time may be set to provide sufficient time for the warning devices 511 to be activated before the vehicle system 540 reaches the crossing 570 or comes within a designated warning distance 506 of the crossing 570. The warning time may provide sufficient time for any other vehicles that are crossing the route of the approaching vehicle system 540 at the crossing to clear the crossing before the warning devices are activated. When the arrival time indicates that the vehicle system 540 is entering or has entered the designated warning distance 506, the crossing module 520 activates the warning devices 511. With respect to absolute time, if the arrival time is 1:15 pm and the designated warning time is one minute (e.g., relative time), then the crossing module 520 may activate the warning devices 511 no later than 1:14 pm. With respect to relative time, if the current arrival time is five minutes and the designated warning time is one minute, then the crossing module 520 may activate the warning devices 511 in no later than four minutes. The crossing module 520 may deactivate the warning devices 511 at the departure time.

In one aspect, once the crossing module 520 activates the warning devices 511, the crossing module 520 does not modify the departure time. The crossing module 520 may stop updating the departure time received from the vehicle system 540 while the warning devices 511 are activated. Alternatively, the crossing module 520 may continue updating the departure time after the warning devices 511 have been activated with subsequent notification messages received from the vehicle system 540 that include different departure times.

Due to one or more problems with communication between the vehicle system 540 and the crossing module 520, a communication loss between the vehicle system 540 and the crossing module 520 may occur such that subsequent notification messages are not received by the crossing module 520. In the event that such a communication loss may occur after the vehicle system 540 has passed the notification location 504, the crossing module 520 may use the arrival time and/or departure time in a previously received notification message, such as the last notification message that was received.

The vehicle system 540 may become aware of the communication loss with the crossing module 520 when the vehicle system 540 stops receiving one or more acknowledgement messages from the crossing module 520 following communication of one or more notification messages. In response, a control system onboard the vehicle system 540 (e.g., the control system 330) may restrict changes in the operational settings of the vehicle system 540. For example, the control system may prevent the vehicle system 540 from being operated in such a way that would cause the vehicle system 540 to arrive at the crossing 570 earlier than the arrival time stored at the crossing module 520. The control system can prevent the vehicle system 540 from traveling faster (e.g., accelerating) such that the vehicle system 540 arrives no earlier than the arrival time in the last notification message that was received and/or acknowledged by the crossing module 520. In one aspect, the control system can restrict operations of the vehicle system 540 by reducing the range of available throttle settings of the vehicle system to a smaller subset of all throttle settings that are otherwise available for the vehicle system to use. Optionally, the control system can prevent the vehicle system 540 from traveling slower (e.g., decelerating) such that the vehicle system 540 arrives no later than the arrival time in the last notification message that was received and/or acknowledged by the crossing module 520.

As another example, the control system may prevent the vehicle system 540 from being operated in such a way that would cause the vehicle system 540 to exit the crossing 570 later than the departure time stored at the crossing module 520. The control system can prevent the vehicle system 540 from traveling faster (e.g., accelerating) such that the vehicle system 540 completes travel through the crossing 570 no earlier than the departure time in the last notification message that was received and/or acknowledged by the crossing module 520. Optionally, the control system can prevent the vehicle system 540 from traveling slower (e.g., decelerating) such that the vehicle system 540 completes travel through the crossing 570 no later than the departure time in the last notification message that was received and/or acknowledged by the crossing module 520.

The control system can prevent these changes in speed by preventing or ignoring (e.g., not implementing) manual or automatic changes to the throttle settings and/or brake settings of the vehicle system 540 that would cause the vehicle system 540 to change speed, arrive at the crossing 570 earlier than the arrival time, arrive at the crossing 570 earlier than the arrival time, exit the crossing earlier than the departure time, and/or exit the crossing 570 later than the departure time. Optionally, the control system can prevent these changes in speed by preventing the trip plan being used by the vehicle system 540 from being further modified or revised.

Operations of some known implementations of wirelessly controlled warning systems at crossings may suffer due to inaccurate warning times (e.g., arrival and/or departure times). The inaccuracies may be due to overly conservative arrival time calculations that are used to account for possible acceleration of the vehicle system and/or communication delays. By increasing the rate at which notification messages are sent, the vehicle system 540 may have continuous or repeated feedback of the health of the communication link between the vehicle system 540 and the crossing module 520. When using an absolute time-based system, relatively small communication delays between the vehicle system 540 and the crossing module 520 may not negatively impact control of the warning devices 511 relative to using relative times.

Figure 6:
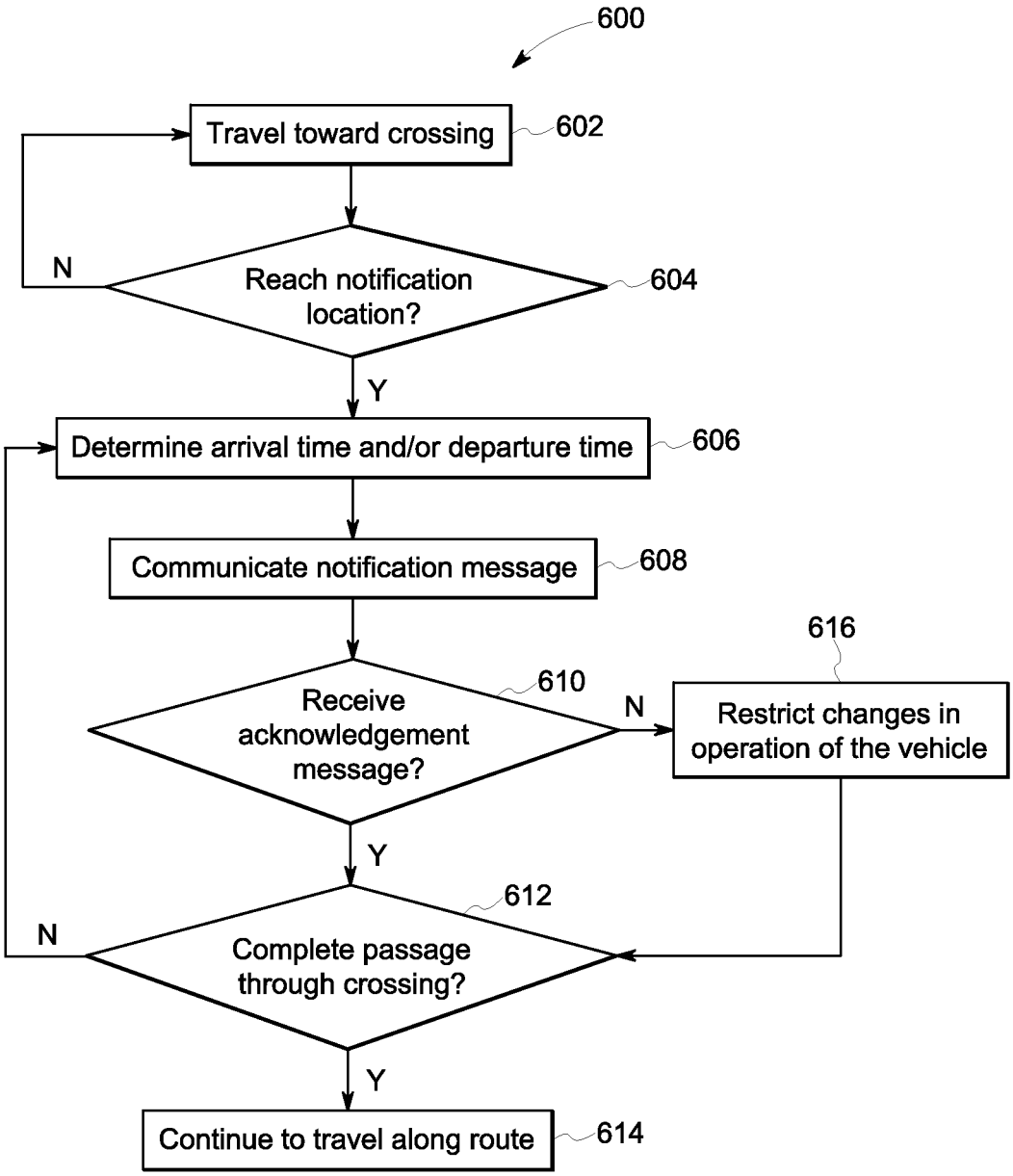
FIG. 6 is a flowchart of a method for controlling a vehicle system in accordance with an embodiment.

FIG. 6 is a flowchart of a method 600 for controlling a vehicle system in accordance with an embodiment. The method 600 may be used to control operations of the vehicle systems described herein approaching a crossing, for example. In one example, the method 600 may represent operations to be performed by one or more computers and/or processors under the direction of a software algorithm.

At 602, the vehicle system travels along a route toward a crossing. At 604, a determination is made as to whether the vehicle system has reached a notification location along the route. As described above, this location can represent the location where the vehicle system is to start repeatedly communicating notification messages to a crossing module. If the vehicle system has reached this location, then the vehicle system may begin communicating notification messages to the crossing module and flow of the method 600 can proceed to 606. Otherwise, the vehicle system may be too far from the crossing module for the notification messages to be received. Consequently, the method 600 may return to 602 and continue in a loop-wise manner until the vehicle system reaches the notification location.

At 606, the arrival time and/or departure time of the vehicle system are determined. The arrival time represents the time (absolute or relative) that the vehicle system expects or calculates it will arrive at the crossing and the departure time represents the time (absolute or relative) that the vehicle system expects to complete travel through the crossing. In one aspect, a buffer time may be included in the departure time. For example, instead of calculating the departure time as the time when the vehicle system is expected to complete travel through the crossing, the departure time may be calculated as the time when the vehicle system is expected to complete travel through the crossing plus an additional amount of time to ensure that the vehicle system is completely through the crossing and sufficiently far away to allow other vehicles to safely cross the route.

At 608, a notification message that includes data representative of the arrival time and/or departure time is communicated (e.g., transmitted or broadcast) from the vehicle system to the crossing module. In one aspect, the crossing module communicates an acknowledgement message to the vehicle system in response to the crossing module receiving a notification message that includes the arrival time and/or departure time.

At 610, a determination is made as to whether an acknowledgement message is received from the crossing module in response to communication of the previously sent notification message. If no acknowledgement message is received, then the absence of the acknowledgement message may indicate that the crossing module did not receive the preceding notification message due to a communication loss between the vehicle system and the crossing module. As a result, operations of the vehicle system may be restricted so as to avoid the vehicle system arriving at the crossing earlier that the last arrival time that was received and acknowledged by the crossing module. Consequently, flow of the method 600 may proceed to 616. On the other hand, if an acknowledgement message is received, then flow of the method 600 may proceed to 612.

At 612, a determination is made as to whether the vehicle system has completed passage through the crossing. If not, then the vehicle system may still be traveling through and/or across the crossing. The vehicle system may continue determining arrival and/or departure times, and communicating additional notification messages to the crossing module. For example, flow of the method 600 may return to 606, where another arrival time and/or departure time are determined and communicated to the crossing module. If the vehicle system has completed travel through the crossing, however, then no additional notification messages may need to be sent to the crossing module. As a result, flow of the method 600 may continue to 614.

At 614, the vehicle system continues to travel along the route. In one aspect, the method 600 may be repeated when the vehicle system approaches another crossing.

Returning to the discussion of 610 in the method 600, if no acknowledgement message was received by the vehicle system, then flow of the method 600 may proceed to 616. At 616, one or more operations of the vehicle system are restricted during continued travel of the vehicle system toward the crossing. For example, the vehicle system may be prevented from traveling at speeds that are fast enough to cause the vehicle system arriving at the crossing earlier than or substantially later than (e.g., by more than a designated amount) the arrival time that was previously or last sent to the crossing module and confirmed by the crossing module (e.g., by receiving an acknowledgement message). The vehicle system may continue traveling to the crossing using the restricted operations at 612 and/or attempting to communicate additional notification messages to the crossing module at 606, 608, as described above.

Figure 7A:
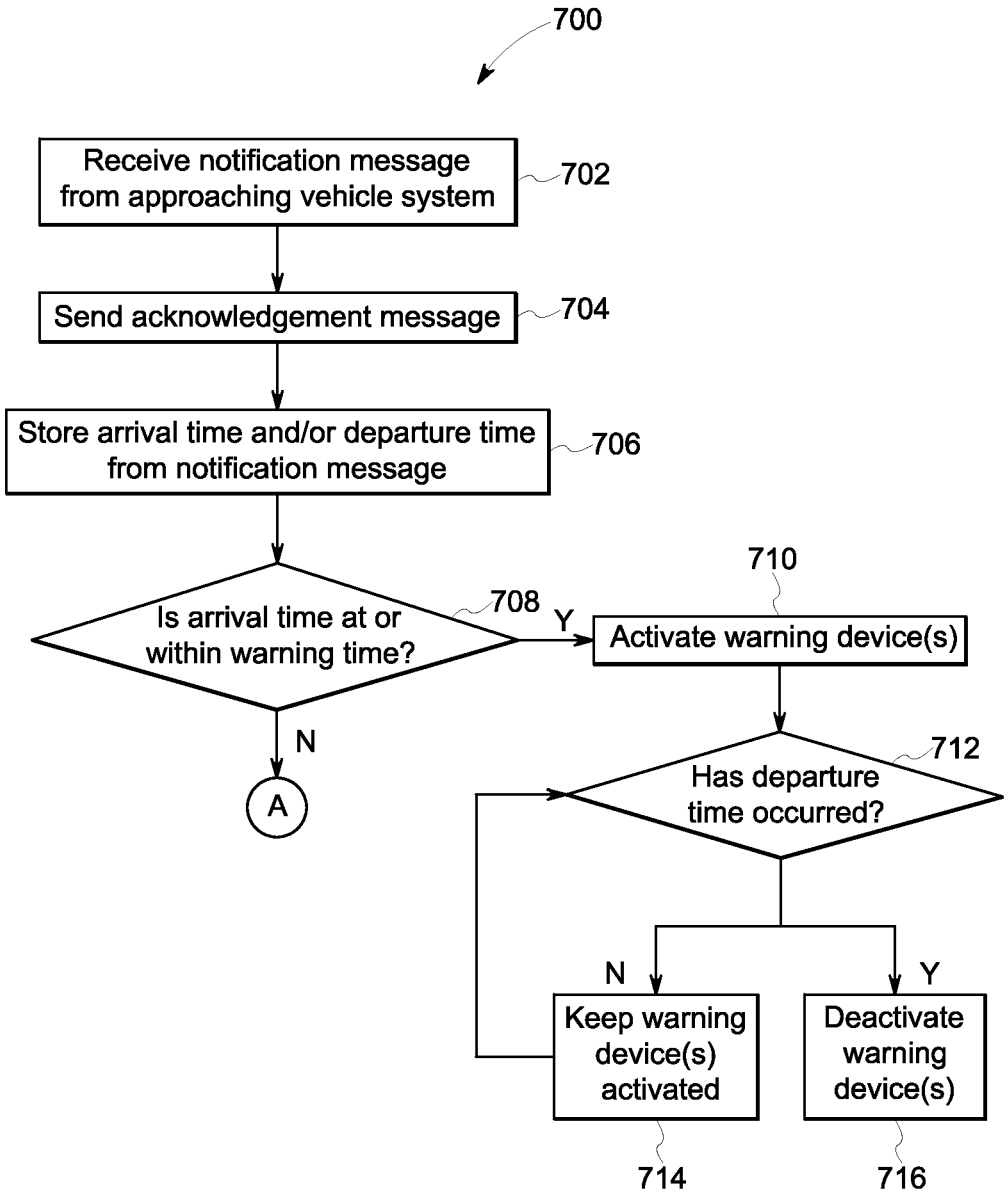
FIG. 7 (which includes parts 7A and 7B) illustrates a flowchart of a method for controlling operations of a crossing module or system, in accordance with an embodiment.
Figure 7B:
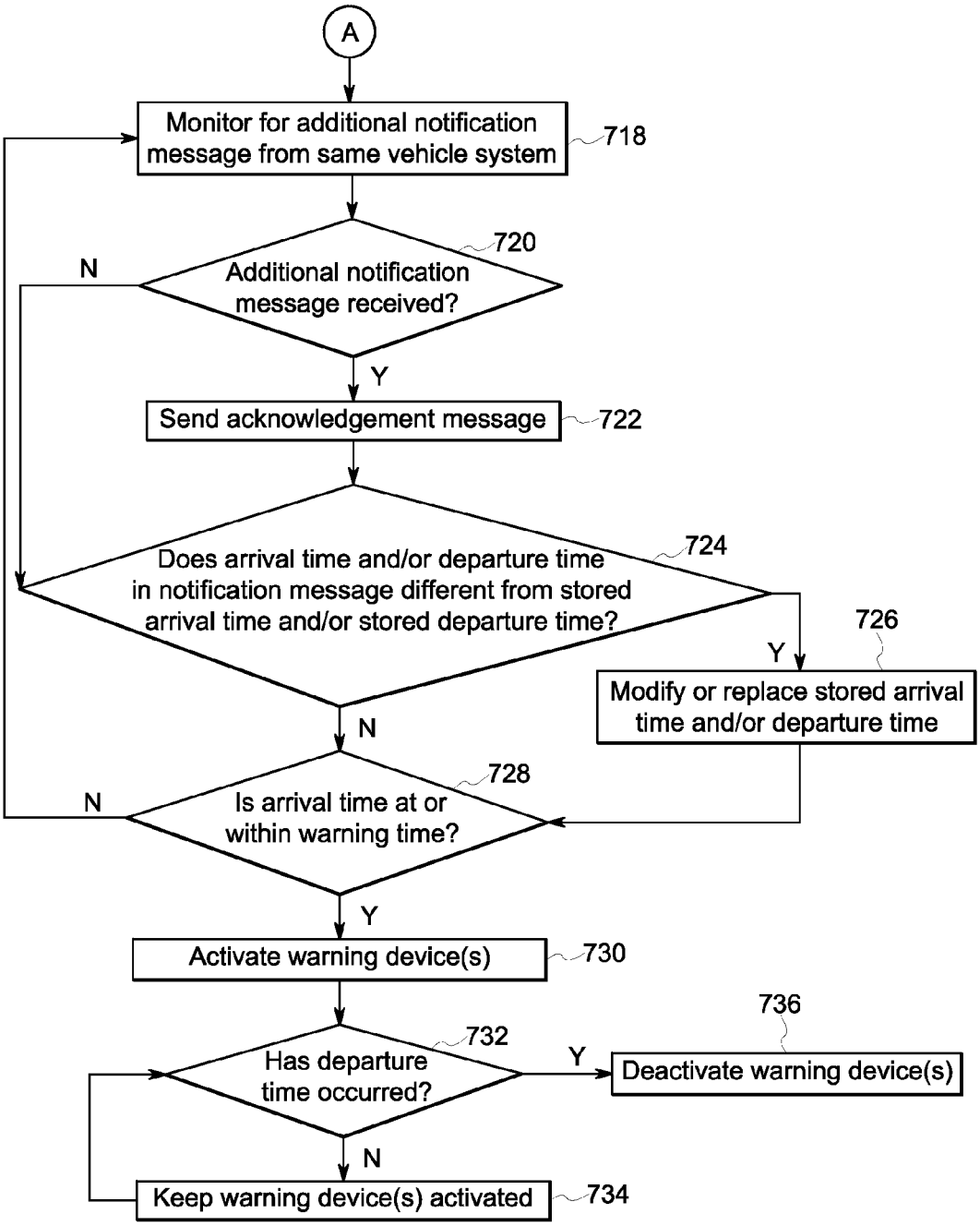

FIG. 7 illustrates a flowchart of a method 700 for controlling operations of a crossing module or system in accordance with an embodiment. The method 700 may be used to control operations of the crossing modules or systems described herein as a vehicle system approaches a crossing having warning devices that are controlled by the crossing modules or systems, for example. In one example, the method 700 may represent operations to be performed by one or more computers and/or processors under the direction of a software algorithm.

At 702, a notification message is received from a vehicle system that is approaching a crossing having one or more warning devices being controlled by a crossing module. The notification message includes data representative of an arrival time and/or departure time, as described above.

At 704, an acknowledgement message is communicated to the vehicle system. This message confirms receipt of the notification message received at 702 to the vehicle system. At 706, the arrival time and/or departure time communicated by the notification message are stored, such as in an internal or external memory that is accessible by the crossing module.

At 708, a determination is made as to whether the received arrival time is at or within a designated warning time. For example, the arrival time is compared to the warning time to determine if the vehicle system is sufficiently close to the crossing that the warning devices need to be activated. If so, flow of the method 700 proceeds to 710. If the arrival time is not at or within the warning time, then the warning devices may not need to be activated because the vehicle system is still sufficiently far away that the warning devices need not be activated. As a result, flow of the method 700 proceeds to 718.

At 710, the warning device(s) are activated. For example, one or more gates may be lowered, one or more lights may be illuminated, one or more alarms, bells, speakers, or the like, may emit sounds, and/or one or more other devices may be activated to warn others that the approaching vehicle system is nearing the crossing.

At 712, a determination is made as to whether the departure time has occurred or passed. If so, then the vehicle system likely has completed travel through the crossing and the warning devices can be deactivated and flow of the method 700 proceeds to 716. But, if the departure time has not yet occurred or passed, then the vehicle system may not yet have completed travel through the crossing. As a result, flow of the method 700 may continue to 714.

At 714, the warning devices are kept active. Flow of the method 700 may return to 712 in a loop-wise manner to keep the warning devices activated until the vehicle system completes travel through the crossing. At 716, the warning devices are deactivated when the departure time occurs. For example, once the vehicle system completely passes through the crossing, the warning devices may be deactivated.

Returning to the discussion of the method 700 at 708, if the arrival time is not at or within the warning time, then the crossing module monitors for additional notification messages from the same vehicle system at 718. The notification messages may include identifiers that identify which vehicle system is sending the notification messages. These identifiers can be used by the crossing modules to distinguish between notification messages communicated by the approaching vehicle as opposed to another vehicle.

At 720, a determination is made as to whether an additional notification message is received from the approaching vehicle system. If so, the arrival time and/or departure time communicated via a previous notification message may need to be updated. As a result, flow of the method 700 may proceed to 722. If no additional notification message is received, then flow of the method 700 may proceed to 724.

At 722, an acknowledgement message is communicated to the vehicle system in order to confirm receipt of the notification message at 720. At 724, a determination is made as to whether the arrival time and/or departure time in the recently received notification message (e.g., at 720) differs from the arrival time and/or departure time received from an earlier notification message and/or stored in a memory accessible by the crossing module. If the newer arrival time and/or departure time differ from the stored arrival time and/or departure time, then the stored arrival time and/or departure time may need to be updated or replaced. As a result, flow of the method 700 may proceed to 726. Otherwise, the stored arrival time and/or departure time may not need to be updated and flow of the method 700 may proceed to 728.

At 728, a determination is made as to whether the stored arrival time is at or within the designated warning time. For example, the arrival time is compared to the warning time to determine if the vehicle system is sufficiently close to the crossing that the warning devices need to be activated. If so, flow of the method 700 proceeds to 730. If the arrival time is not at or within the warning time, then the warning devices may not need to be activated because the vehicle system is still sufficiently far away that the warning devices need not be activated. As a result, flow of the method 700 returns to 718. For example, the method 700 may proceed in a loop-wise manner to monitor for additional notification messages.

At 730, the warning device(s) are activated. For example, one or more gates may be lowered, one or more lights may be illuminated, one or more alarms, bells, speakers, or the like, may emit sounds, and/or one or more other devices may be activated to warn others that the approaching vehicle system is nearing the crossing.

At 732, a determination is made as to whether the departure time has occurred or passed. If so, then the vehicle system likely has completed travel through the crossing and the warning devices can be deactivated and flow of the method 700 proceeds to 736. But, if the departure time has not yet occurred or passed, then the vehicle system may not yet have completed travel through the crossing. As a result, flow of the method 700 may continue to 734.

At 734, the warning devices are kept active. Flow of the method 700 may return to 732 in a loop-wise manner to keep the warning devices activated until the vehicle system completes travel through the crossing. At 736, the warning devices are deactivated when the departure time occurs. For example, once the vehicle system completely passes through the crossing, the warning devices may be deactivated.

As described herein, the arrival times that are communicated from the vehicle systems 140, 540 to the crossing modules 120, 520 may be communicated as absolute times or relative times. Although the use of absolute times has some advantages over the use of relative times, clock synchronization errors and other errors can cause the use of absolute times to be problematic. For example, the processing units 122 (shown in FIG. 1) of the crossing modules 120, 520 may track absolute time using an internal clock. Such an internal clock may be implemented by the crossing determination module 126 of the crossing modules 120, 520. For example, the crossing determination module 126 may include or represent hardware and/or software that tracks the current absolute time (e.g., UTC, GMT, or other time). The crossing determination module 126 may update the absolute time being monitored such as by receiving a reference absolute time from a remote location via wireless and/or wired communication. The update may occur by modifying the absolute time being tracked by the crossing determination module 126 with a reference absolute time obtained or received from the remote location, such as a remote server, computer, clock, GPS satellite, or the like. If the absolute time being tracked by the crossing determination module 126 does not match the reference absolute time received from the remote location when the reference absolute time is received, then the crossing determination module 126 may change the absolute time being tracked by the crossing determination module 126 to match or otherwise correspond with the reference absolute time. Updating the absolute time being tracked by the crossing determination module 126 from time-to-time can help to ensure that the absolute time being tracked by vehicle systems 140, 540 matches or otherwise corresponds with the absolute time being tracked by the crossing modules 120, 520. If these absolute times being tracked by the vehicle systems and the crossing modules do not match or correspond relatively close with each other, then the activation of warning devices 111, 511 based on absolute times may occur at the wrong time (e.g., after the vehicle system 140, 540 has entered into the crossing and/or too soon before the vehicle system 140, 540 enters the crossing).

Synchronization errors can occur when the absolute time being tracked by the crossing module 120, 520 is updated. For example, one or more components of the crossing module 120, 520 may "freeze" or otherwise stop performing designated functions and, as a result, the absolute time is not updated or is updated incorrectly (e.g., does not reflect the reference absolute time communicated to the crossing module 120, 520). As another example, electronic drift in the electronic signals, voltages, and/or currents used to track the absolute time by the crossing module 120, 520 can result in the absolute time gradually becoming different from the reference absolute time being tracked by the remote location that updates the crossing module 120, 520. In another example, the reference absolute time used to update the absolute time being tracked by one of the vehicle system 140, 540 or the crossing module 120, 520 may be different from the reference absolute time used to update the absolute time being tracked by the other of the crossing module 120, 520 or the vehicle system 140, 540. For example, the clocks being maintained by the vehicle system 140, 540 and the crossing module 120, 520 may be updated with different times such that the clocks no longer match or otherwise correspond with each other.

Mismatches between clocks (e.g., the absolute times) being maintained by vehicle systems 140, 540 and the crossing modules 140, 540 can pose significant safety risks to those onboard the vehicle systems 140, 540 and/or those on other vehicles or vehicle systems attempting to travel through the crossing 570. The warning devices 511 may end up being activated too soon or too late by the crossing modules 140, 540. The following steps outline an example of a potential hazard associated with using absolute time to determine when to activate a WMDR rather than converting to relative time.

For example, a message (such as a notification message) may be communicated from the vehicle system 140, 540 to the crossing module 140, 540 that requests the warning devices 511 be activated at an arrival time and/or indicates an arrival time of the vehicle system 140, 540 at or near the crossing. The arrival time may be expressed in absolute time, such as 13:33:31 (e.g., 1:33:31 pm) on 17 Nov. 2013. The vehicle system 140, 540 may calculate the arrival time from a system time of the vehicle system 140, 540. The term "system time" refers to the absolute time being tracked by a system being referred to. For example, the clock onboard the vehicle system 140, 540 may be referred to as the vehicle system time and the clock being maintained by the crossing module 120, 520 may be referred to as the warning system time.

When the notification message from the vehicle system 140, 540 is received by the crossing module 120, 520, the warning system time may be 13:32:31 (e.g., 1:32:31 pm) on 17 Nov. 2013. As a result, the vehicle system 140, 540 expects to arrive at the crossing 570 in sixty seconds. Due to an error on a time synchronization server shortly after receiving the notification message (e.g., five seconds after receiving the notification message) but prior to the arrival time indicated by the notification message, the system times (e.g., clocks) of the vehicle system 140, 540 and of the crossing module 120, 520 may be updated to 12:33:26 (e.g., 12:33:26 pm), 17 Nov. 2013. The time synchronization server may be a remote system that updates the clock of the crossing module 120, 520 and/or the vehicle system 140, 540.

Regardless of whether this updated system time is correct or incorrect, the warning system time is one hour prior to what the warning system time was when the notification message was received by the crossing module 120, 520. Although the vehicle system 140, 540 should actually arrive at the crossing 570 in 55 seconds. Because the warning system time of the crossing module 120, 520 has been updated after the notification time was communicated, the crossing module 120, 520 now expects the vehicle system 140, 540 will not arrive at the crossing 570 for 59 minutes and 55 seconds, instead of 55 seconds. Without correcting the warning system clock, the vehicle system 140, 540 may arrive and pass through the crossing 570 approximately 55 seconds later, but without the crossing module 120, 520 activating the warning devices 511. Then, approximately 59 minutes later, the crossing module 120, 520 may activate the warning devices 511, regardless of whether the vehicle system 140, 540 or another vehicle system is present at or near the crossing 570.

Conversely, the vehicle system time may not match the warning system time (due to a synchronization error or other error) and cause the vehicle system 140, 540 to send an incorrect absolute arrival time to the crossing module 120, 520. For example, although the vehicle system 140, 540 actually will arrive at the crossing 570 in approximately 55 seconds, the arrival time that is sent by the vehicle system 140, 540 to the crossing module 120, 520 may indicate that the vehicle system 140, 540 will arrive at the crossing 570 in approximately 59 minutes and 55 seconds according to the warning system time.

In order to prevent such an error in clocks from causing the warning devices 511 being activated at the wrong time(s) or not activated at the correct time, the crossing module 120, 520 may modify the absolute arrival time that is received via the notification message from the vehicle system 140, 540. For example, the vehicle system 140, 540 may still communicate the arrival time as an absolute time (as described above). Upon receipt, the crossing module 120, 520 can convert the absolute time into a relative time. Such a relative time can represent a countdown or timer until the vehicle system 140, 540 expects to arrive at the crossing 570. The crossing module 120, 520 may then use the converted relative time as a countdown and activate the warning devices 511 when the relative time occurs (e.g., when the countdown expires).

For example, a notification message from the vehicle system 140, 540 may be received at the crossing module 120, 520. The notification message may indicate the arrival time of the vehicle system 140, 540 in absolute time, such as 13:33:31 on 17 Nov. 2013. The warning system time of the crossing module 120, 520 may be 13:32:31 17 Nov. 2013, meaning that the vehicle system 140, 540 is expected to arrive at the crossing 570 in approximately sixty seconds.

The crossing module 120, 520 converts the absolute arrival time into a relative arrival time. For example, the processing unit 122 (e.g., the crossing determination module 126) of the crossing module 120, 520 may convert the absolute arrival time into a relative arrival time. The processing unit 122 may determine the relative arrival time by calculating the length of the time period between the absolute arrival time received from the vehicle system 140, 540 and the warning system time of the crossing module 120, 520. Although there may be some communication delay between the sending of the notification message by the vehicle system 140, 540 and the receipt of the notification message by the crossing module 120, 520, this communication delay may not result in any error in the relative arrival time that is calculated because the relative arrival time is still expressed in absolute time from the vehicle system 140, 540.

In one aspect, the crossing module 120, 520 may perform one or more checks on the validity of the arrival time received in the notification message. By way of example, if the absolute arrival time of the vehicle system 140, 540 differs from the warning system time by more than a designated threshold time, then the crossing module 120, 520 may reject the absolute arrival time (e.g., not use this absolute arrival time to determine when to activate the warning devices 511). The designated threshold time may indicate an amount of time that corresponds to the vehicle system 140, 540 traveling at a speed limit (e.g., the track speed or upper speed limit of the route 102, 502 leading up to the crossing 170, 570) over a designated distance. For example, the designated threshold time may represent the amount of time that it would take a vehicle system to travel 1, 3, or 5 kilometers (or another distance) when the vehicle system travels at the speed limit of the route 102, 502. This distance may be determined from an actual, current location of the vehicle system, a designated distance, from the distance between the crossing and the notification location 504, or another distance. Optionally, the designated threshold time may be a set period of time, such as 5, 15, or 30 minutes (or another time). Another check on the absolute arrival time may be a comparison between the absolute arrival time and the warning system time to determine if the absolute arrival time represents a time that already has passed (according to the warning system time) or that occurs on another date.

The crossing module 120, 520 additionally or alternatively may determine if the warning system time has been recently updated. For example, the crossing module 120, 520 may determine if the clock being used by the crossing module 120, 520 has been updated within a designated time period, such as a time period representative of typically or previously experienced or measured communication delays between the vehicle system 140, 540 and the crossing module 120, 520, or another time period. If the warning system time has been recently updated, then the crossing module 120, 520 may send a repeat message to the vehicle system 140, 540. Such a message may request that the vehicle system 140, 540 re-send the arrival time.

The vehicle system 140, 540 additionally or alternatively may determine if the vehicle system time has been recently updated. For example, the vehicle system 140, 540 may determine if the clock being used by the vehicle system 140, 540 has been updated within a designated time period. If the vehicle system time has been recently updated, then the vehicle system 140, 540 may notify the crossing module 120, 520 of this recent update. The crossing module 120, 520 may examine the absolute arrival time in light of this notification of the recent update sent by the vehicle system 140, 540 to determine if the absolute arrival time is correct or needs to be re-sent.

If the crossing module 120, 520 determines that the absolute arrival time is not valid using one or more of these checks, then the crossing module 120, 520 may not use the absolute arrival time and may send a responsive message back to the vehicle system 140, 540. This responsive message may indicate that the absolute arrival time was rejected and request an additional (e.g., corrected) arrival time.

If the crossing module 120, 520 determines that the absolute arrival time appears to be valid, then the crossing module 120, 520 (e.g., the processing unit 122) may convert the received absolute time into relative time. The crossing module 120, 520 may then begin counting down from the relative time. For example, if the absolute arrival time indicates that the vehicle system 140, 540 will arrive in 55 seconds, then the crossing module 120, 520 may begin counting down from 55 seconds. When this countdown expires (e.g., in 55 seconds), the crossing module 120, 520 activates the warning devices 111, 511, as described above. The warning devices are activated at the time when the vehicle system 140, 540 reaches the crossing 170, 570, regardless of whether the warning system time is updated after the absolute arrival time is received but before the time indicated by the absolute arrival time occurs.

As described above, the vehicle system 140, 540 may repeatedly communicate absolute arrival times to the crossing module 120, 520 as the vehicle system 140, 540 approaches the crossing 170, 570. The crossing module 120, 520 may convert the absolute arrival times into relative times and use the relative time (e.g., the relative arrival time corresponding to the most recently received and valid absolute arrival time) to determine when to activate the warning devices 511.

In an embodiment, a system includes a determination module and a communication module. The determination module is configured to be located onboard a first vehicle configured to travel along a first route. The first route includes a crossing corresponding to an intersection of the first route with a second route. The determination module is configured to be communicatively coupled with a crossing module that is configured to impede travel of a second vehicle along the second route through the crossing when the first vehicle is proximate the crossing. The determination module is configured to determine, based on a speed of the first vehicle, timing information corresponding to a time at which the first vehicle will travel proximate the crossing. The communication module is configured to communicatively couple the determination module to the crossing module, and to transmit the timing information to the crossing module. The timing information includes a reference time corresponding to a time for impeding travel of the second vehicle along the second route through the crossing, and is configured as an absolute time.

In another aspect, the system may be configured to transmit the timing information before the first vehicle enters a range of an automatic closure module associated with the crossing module when the first vehicle is traveling at a speed that is slower than a reference speed. The reference speed corresponds to a speed for which the automatic closure module is configured to impede travel of the second vehicle along the second route through the crossing.

In another aspect, the communication module may be configured to transmit a suppression message to the crossing module. The suppression message is configured to prevent operation of the automatic closure module when the first vehicle travels slower than the reference speed. Further, in various embodiments, the first route may include plural sub-routes, and the suppression information may include sub-route identification information corresponding to a particular sub-route on which the first vehicle is traveling.

In another aspect, the first vehicle may be configured as an electric powered vehicle configured to receive energy from at least one of a rail or overhead power source.

In another aspect, the reference time may be a time at which the first vehicle will enter the crossing.

In another aspect, the reference time may be a time at which a gate corresponding to the crossing is to be closed.

In an embodiment, a system includes a crossing module configured to be disposed along a first route along which a first vehicle is configured to travel. The first route includes a track and a crossing corresponding to an intersection of the first route with a second route. The crossing module is configured to impede travel of a second vehicle along the second route through the crossing when the first vehicle is proximate the crossing on the first route. The crossing module includes a communication module, a determination module, and an automatic closure module. The communication module is configured to communicatively couple the crossing module to the first vehicle and to receive timing information from the first vehicle. The timing information includes a reference time corresponding to a time for impeding travel of the second vehicle along the second route through the crossing, with the reference time configured as an absolute time. The determination module is configured to determine a closing time to impede travel along the second route using the timing information. The automatic closure module is configured to impede travel along the second route using information obtained from a track detection system configured to detect signals sent via the track.

In another aspect, the crossing module may be configured to receive the timing information before the first vehicle enters a range of the automatic closure module when the first vehicle is traveling at a speed that is slower than a reference speed. The reference speed corresponds to a speed for which the automatic closure module is configured to impede travel of the second vehicle along the second route through the crossing. The timing information may include a suppression message, wherein the crossing module is configured to suppress operation of the automatic closure module responsive to receiving the suppression message. Further, in various embodiments, the first route may include plural sub-routes, and the suppression information may include sub-route identification information corresponding to a particular sub-route on which the first vehicle is traveling. The crossing module may be configured to override the suppression message when the automatic crossing module receives information corresponding to a closing condition from a portion of the route other than the particular sub-route on which the first vehicle is traveling.

In another aspect, the automatic closure module may be configured to receive information from a crossing predictor detection system comprising a shunt positioned along the first route. The automatic closure module may be configured to impede travel of the second vehicle along the second route through the crossing based on a speed and location of the first vehicle determined using the information from the crossing predictor detection system.

In another aspect, the automatic closure module may be configured to receive information from a track occupancy detection system. The automatic closure module may be configured to impede travel of the second vehicle along the second route through the crossing based on a track occupancy.

In another aspect, the closing time may be configured as an absolute time.

An embodiment relates to a method that includes determining, at a processing unit disposed onboard a first vehicle configured to travel along a first route, timing information corresponding to a time at which the first vehicle will travel proximate a crossing based on a speed of the first vehicle. The crossing corresponds to an intersection of the first route with a second route. The method also includes communicating the timing information to a crossing module disposed along the first route proximate the crossing. The crossing module is configured to impede travel of a second vehicle along the second route through the crossing when the first vehicle is proximate the crossing on the first route. The timing information includes a reference time configured as an absolute time corresponding to a time for impeding travel of the second vehicle along the second route through the crossing.

In an embodiment of the method, the timing information is communicated to the crossing module before the first vehicle enters a range of an automatic closure module associated with the crossing module when the first vehicle is traveling at a speed that is slower than a reference speed. The reference speed corresponds to a speed for which the automatic closure module is configured to impede travel by the second vehicle along the second route through the crossing. In various embodiments, the method may also include communicating a suppression message to the crossing module. The suppression message is configured to prevent operation of the automatic closure module. Further still, in various embodiments, the first route may include plural sub-routes, and the suppression information may include sub-route identification information corresponding to a particular sub-route on which the first vehicle is traveling, with the method further including overriding the suppression message when a different vehicle approaches the crossing on a portion of the first route other than the particular sub-route on which the first vehicle is traveling.

In an embodiment of the method, the first vehicle may be configured as an electric powered vehicle configured to receive energy from at least one of a rail or overhead power source.

In an embodiment of the method, the reference time is a time at which the first vehicle will enter the crossing.

In an embodiment of the method, the reference time is a time at which a gate corresponding to the crossing is to be closed.

In an embodiment, a system includes a timing determination module configured to be disposed onboard an approaching vehicle system during travel of the approaching vehicle system along a first route toward a crossing between the first route and a second route. The timing determination module is configured to determine one or more arrival times of the approaching vehicle system to reach the crossing and to repeatedly communicate notification messages having the one or more arrival times to a crossing system that is configured to activate one or more warning devices disposed at or near the crossing to notify other vehicles on the second route that the approaching vehicle system is approaching the crossing along the first route. The timing determination module is configured to determine the one or more arrival times at different respective locations along the first route as the approaching vehicle system travels toward the crossing.

In one aspect, the timing determination module is configured to determine the one or more arrival times as absolute times.

In one aspect, the timing determination module is configured to determine the one or more arrival times as relative times.

In one aspect, the one or more arrival times that are determined by the timing determination module differ from each other at different locations of the approaching vehicle system along the first route.

In one aspect, the timing determination module is configured to begin determining the one or more arrival times only when the approaching vehicle system reaches a notification location along the first route.

In one aspect, the timing determination module is configured to determine the same arrival time at plural different locations along the first route.

In one aspect, the timing determination module is configured to determine one or more departure times of the approaching vehicle system to pass through and complete travel through the crossing and to repeatedly communicate the notification messages with the one or more departure times to the remote communication module.

In one aspect, the timing determination module is configured to calculate the one or more arrival times based on a current distance of the approaching vehicle system to the crossing along the first route and a current speed of the approaching vehicle system.

In one aspect, the timing determination module is configured to calculate the one or more arrival times based on a current distance of the approaching vehicle system to the crossing along the first route and one or more operational settings of the approaching vehicle system that are designated by a trip plan of the approaching vehicle system.

In one aspect, the one or more arrival times include two or more different arrival times due to changes in speed of the approaching vehicle system.

In one aspect, the system also includes a control system configured to be disposed onboard the approaching vehicle system. The control system is configured to restrict operations of the approaching vehicle system responsive to the approaching vehicle system not receiving an acknowledgement message from the crossing module when a previous one of the notification messages is communicated to the crossing module. The control system is configured to restrict the operations of the approaching vehicle system such that the approaching vehicle system arrives at the crossing no sooner than the arrival time communicated in a previous notification message for which an acknowledgement message was received by the approaching vehicle system.

In an embodiment, a method includes determining, onboard an approaching vehicle system, one or more arrival times of the approaching vehicle system during travel of the approaching vehicle system along a first route toward a crossing between the first route and a second route. The method also includes repeatedly communicating notification messages with the one or more arrival times to a crossing module that is configured to activate one or more warning devices disposed at or near the crossing to notify other vehicles on the second route that the approaching vehicle system is approaching the crossing along the first route. The one or more arrival times are determined at different respective locations along the first route as the approaching vehicle system travels toward the crossing.

In one aspect, the one or more arrival times are absolute times.

In one aspect, the one or more arrival times are relative times.

In one aspect, the one or more arrival times differ from each other at different locations of the approaching vehicle system along the first route.

In one aspect, determining the one or more arrival times begins only when the approaching vehicle system reaches a notification location along the first route.

In one aspect, the one or more arrival times include the same arrival time determined at plural different locations along the first route.

In one aspect, the method also includes determining, onboard the approaching vehicle system, one or more departure times of the approaching vehicle system to pass through and complete travel through the crossing. The notification messages are repeatedly communicated with the one or more departure times to the remote communication module.

In one aspect, the one or more arrival times are calculated using a current distance of the approaching vehicle system to the crossing along the first route and a current speed of the approaching vehicle system.

In one aspect, the one or more arrival times are calculated based on a current distance of the approaching vehicle system to the crossing along the first route and one or more operational settings of the approaching vehicle system that are designated by a trip plan of the approaching vehicle system.

In one aspect, the method also includes restricting operations of the approaching vehicle system responsive to the approaching vehicle system not receiving an acknowledgement message from the crossing module when a previous one of the notification messages is communicated to the crossing module. The operations of the approaching vehicle system are restricted such that the approaching vehicle system arrives at the crossing no sooner than the arrival time communicated in a previous notification message for which an acknowledgement message was received by the approaching vehicle system.

In an embodiment, a system includes a crossing module configured to activate one or more warning devices disposed at or near a crossing between a first route being traveled by an approaching vehicle and a second route to notify other vehicles on the second route that the approaching vehicle system is approaching the crossing along the first route. The crossing module also is configured to receive plural notification messages from the approaching vehicle system. The notification messages including one or more arrival times of the approaching vehicle system that represent when the approaching vehicle system is expected to arrive at the crossing and that are determined at two or more different locations along the first route. The crossing module is configured to activate the one or more warning devices responsive to at least one of the arrival times being within a designated warning time of the crossing module.

In one aspect, the one or more arrival times are absolute times.

In one aspect, the one or more arrival times are relative times.

In one aspect, the crossing module is configured to activate the one or more warning devices when the arrival time communicated in a previous notification message is at or later than the warning time.

In one aspect, the crossing module is configured to compare the arrival time communicated in a subsequently received notification message with the arrival time communicated in a previously received notification message to determine if the arrival times of the subsequently received and previously received notification messages differ and, if the arrival times of the subsequently received and previously received notification messages differ, using the arrival time of the subsequently received notification message to control when the one or more warning devices are activated.

In an embodiment, a method includes receiving plural notification messages from an approaching vehicle system at a crossing module configured to activate one or more warning devices disposed at or near a crossing between a first route being traveled by the approaching vehicle and a second route to notify other vehicles on the second route that the approaching vehicle system is approaching the crossing along the first route. The notification messages include one or more arrival times of the approaching vehicle system that represent when the approaching vehicle system is expected to arrive at the crossing and that are determined at two or more different locations along the first route. The method also includes activating the one or more warning devices responsive to at least one of the arrival times being within a designated warning time of the crossing module.

In one aspect, the one or more arrival times are absolute times.

In one aspect, the one or more arrival times are relative times.

In one aspect, the one or more warning devices are activated when the arrival time communicated in a previous notification message is at or later than the warning time.

In one aspect, the method also includes comparing the arrival time communicated in a subsequently received notification message with the arrival time communicated in a previously received notification message to determine if the arrival times of the subsequently received and previously received notification messages differ and, if the arrival times of the subsequently received and previously received notification messages differ, using the arrival time of the subsequently received notification message to control when the one or more warning devices are activated.

In one example of the inventive subject matter described herein, a method (e.g., for controlling warnings at crossings) includes receiving one or more absolute times associated with movement of a vehicle system. The one or more absolute times are communicated from the vehicle system to notify of at least one of an arrival or departure of the vehicle system at a crossing between a first route being traveled by the vehicle system and a second route. The method also includes modifying at least one of the one or more absolute times into a first relative time and controlling one or more warning devices using the first relative time. The one or more warning devices are controlled to at least one of notify one or more other vehicles traveling along the second route of the at least one of arrival or departure of the vehicle system at the crossing or prevent the one or more other vehicles from traveling through the crossing along the second route.

In one aspect, at least one of receiving the one or more absolute times, modifying the one or more absolute times, or controlling the one or more warning devices is performed using one or more computer processors.

In one aspect, the method also can include tracking a system time of the one or more warning devices using one or more clocks and comparing a difference between the system time and the one or more absolute times received from the vehicle system. The one or more warning devices can be controlled responsive to the difference between the system time and the one or more absolute times received from the vehicle system being no greater than a designated threshold time period. The designated threshold time period can be based on an amount of time corresponding to the vehicle system traveling at an upper speed limit of the first route to the crossing.

In one aspect, the method also can include determining if (or, determining when) the one or more absolute times received from the vehicle system already has passed and, responsive to determining that the one or more absolute times received from the vehicle system already has passed, communicating a responsive message to the vehicle system that requests one or more additional absolute times from the vehicle system. The one or more additional absolute times can be received from the vehicle system and converted into the relative time that is used to control the one or more warning devices.

In one aspect, the method also can include tracking a system time of the one or more warning devices using one or more clocks, determining whether the system time has been updated within a designated time period, and, responsive to determining that the system time has not been updated within the designated time period, communicating a responsive message to the vehicle system that requests one or more additional absolute times from the vehicle system. The one or more additional absolute times can be received from the vehicle system and converted into the first relative time that is used to control the one or more warning devices.

In one aspect, receiving the one or more absolute times can include receiving plural different absolute times from the vehicle system and modifying the one or more absolute times includes modifying the plural different absolute times into plural different relative times. Controlling the one or more warning devices can include controlling the one or more warning devices based on the relative time of the plural different relative times that is a shorter time period than one or more other relative times of the plural different relative times.

In one aspect, the one or more warning devices can include a gate that is activated upon expiration of the relative time to prevent passage of the one or more other vehicles.

In one aspect, the one or more warning devices can include at least one of a light or a speaker that is activated upon expiration of the relative time to notify of arrival of the vehicle system at the crossing.

In one aspect, the relative time can represent a measurement of a time period extending from a current time until the vehicle system arrives at the crossing.

In one aspect, the absolute time can be converted into the first relative time due to a clock associated with the one or more warning devices causing the absolute time to incorrectly indicate when the vehicle system arrives at the crossing.

In another example of the inventive subject matter described herein, a system (e.g., a warning crossing system) includes a crossing module configured to receive one or more absolute times associated with movement of a vehicle system. The one or more absolute times can be communicated from the vehicle system to notify of at least one of an arrival or departure of the vehicle system at a crossing between a first route being traveled by the vehicle system and a second route. The crossing module can be configured to modify at least one of the one or more absolute times into a first relative time and to control one or more warning devices using the first relative time. The one or more warning devices can be controlled to at least one of notify one or more other vehicles traveling along the second route of the at least one of arrival or departure of the vehicle system at the crossing or prevent the one or more other vehicles from traveling through the crossing along the second route.

In one aspect, the crossing module also can be configured to compare a difference between a system time tracked by one or more clocks of the one or more warning devices and the one or more absolute times received from the vehicle system. The crossing module also can be configured to control the one or more warning devices responsive to the difference between the system time and the one or more absolute times received from the vehicle system being no greater than a designated threshold time period, the designated threshold time period based on an amount of time corresponding to the vehicle system traveling at an upper speed limit of the first route to the crossing.

In one aspect, the crossing module can be configured to determine if (or, to determine when) the one or more absolute times received from the vehicle system already has passed and the crossing module can be configured to communicate a responsive message to the vehicle system that requests one or more additional absolute times from the vehicle system responsive to determining that the one or more absolute times received from the vehicle system already has passed. The crossing module can be configured to convert the one or more additional absolute times into the first relative time that is used to control the one or more warning devices responsive to receiving the one or more additional absolute times from the vehicle system.

In one aspect, the crossing module can be configured to determine when a system time tracked by one or more clocks of the one or more warning devices has been updated within a designated time period. The crossing module also can be configured to communicate a responsive message to the vehicle system that requests one or more additional absolute times from the vehicle system, to receive the one or more additional absolute times from the vehicle system, and to convert the one or more additional absolute times into the first relative time that is used to control the one or more warning devices responsive to determining that the system time has not been updated within the designated time period.

In one aspect, the crossing module can be configured to receive the one or more absolute times as plural different absolute times, to modify the one or more absolute times into plural different relative times, and to control the one or more warning devices based on the first relative time of the plural different relative times that is a shorter time period than one or more other relative times of the plural different relative times.

In one aspect, the crossing module can be configured to at least one of control a gate that is activated upon expiration of the first relative time to prevent passage of the one or more other vehicles through the crossing or at least one of a light or a speaker that is activated upon expiration of the relative time to notify of arrival of the vehicle system at the crossing.

In one aspect, the first relative time can represent a measurement of a time period extending from a current time until the vehicle system arrives at the crossing.

In one aspect, at least one of the one or more absolute times is modified into the first relative time due to modification of a clock associated with the one or more warning devices causing the at least one of the one or more absolute times to incorrectly indicate when the vehicle system arrives at the crossing.

In one aspect, the crossing module includes one or more computer processors.

In another example, a system (e.g., a warning crossing system) includes a crossing module and one or more warning devices. The crossing module includes one or more computer processors configured to receive an absolute time associated with movement of a first vehicle system along a first route toward a crossing between the first route and a second route. The absolute time represents at least one of an arrival time of the first vehicle system at the crossing or a departure time at which the vehicle system is expected to complete passage through the crossing. The crossing module also can be configured to modify the absolute time into a relative time. The one or more warning devices include at least one of a gate or a light. The crossing module is configured to at least one of activate the gate upon expiration of the relative time to prevent passage of one or more other vehicles through the crossing along the second route, activate the light upon expiration of the relative time to notify the one or more other vehicles of arrival of the first vehicle system at the crossing, or activate the gate to prevent the one or more other vehicles from passing through the crossing along the second route until the relative time indicates that the first vehicle system has completed passage through the crossing along the first route.

In one aspect, the absolute time can be communicated from the first vehicle system to the crossing module. For example, the crossing module can be configured to receive the absolute time from the first vehicle system.

In one aspect, the crossing module is configured to compare a difference between a system time of the one or more warning devices and the absolute time received from the vehicle system. The crossing module also can be configured to control the one or more warning devices responsive to the difference between the system time and the absolute time received from the vehicle system being no greater than a designated threshold time period. The designated threshold time period can be based on an amount of time corresponding to the vehicle system traveling at an upper speed limit of the first route to the crossing.

In an embodiment, a method (e.g., for controlling warning devices at crossings) includes receiving one or more absolute times associated with movement of a train or other rail vehicle. The one or more absolute times are communicated from the train or other rail vehicle to notify of at least one of an arrival or departure of the train or other rail vehicle at a crossing between a track being traveled by the train or other rail vehicle and a road. The method also includes modifying at least one of the one or more absolute times into a first relative time and controlling one or more warning devices using the first relative time. The one or more warning devices are controlled to at least one of notify one or more automobiles, trucks, or other on-highway vehicles traveling along the road of the at least one of arrival or departure of the train or other rail vehicle at the crossing or prevent the one or more automobiles, trucks, or other on-highway vehicles from traveling through the crossing along the road (i.e., the on-highway vehicle(s) is prevented from crossing the track).

In another embodiment, a system (e.g., a warning crossing system) includes a crossing module configured to receive one or more absolute times associated with movement of a train or other rail vehicle. The one or more absolute times can be communicated from the train or other rail vehicle to notify of at least one of an arrival or departure of the train or other rail vehicle at a crossing between a track being traveled by the train or other rail vehicle and a road. The crossing module can be configured to modify at least one of the one or more absolute times into a first relative time and to control one or more warning devices using the first relative time. The one or more warning devices can be controlled to at least one of notify one or more automobiles, trucks, or other on-highway vehicles traveling along the road of the at least one of arrival or departure of the train or other rail vehicle at the crossing or prevent the one or more automobiles, trucks, or other on-highway vehicles from traveling through the crossing along the road (i.e., the on-highway vehicle(s) is prevented from crossing the track).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A method comprising:

receiving one or more absolute times associated with movement of a vehicle system, the one or more absolute times communicated from the vehicle system to notify of at least one of an arrival or departure of the vehicle system at a crossing between a first route being traveled by the vehicle system and a second route, the one or more absolute times specified in accordance with a synchronization scheme used by additional entities in addition to the vehicle system;

modifying at least one of the one or more absolute times into a first relative time, the first relative time specified with reference to a particular event; and controlling one or more warning devices using the first relative time, the one or more warning devices controlled to at least one of notify one or more other vehicles traveling along the second route of the at least one of arrival or departure of the vehicle system at the crossing or prevent the one or more other vehicles from traveling through the crossing along the second route.

2. The method of claim 1, further comprising tracking a system time of the one or more warning devices and comparing a difference between the system time and the one or more absolute times received from the vehicle system, wherein the system time is specified by a clock maintained by the one or more warning devices, wherein controlling the one or more warning devices occurs responsive to the difference between the system time and the one or more absolute times received from the vehicle system being no greater than a designated threshold time period, the designated threshold time period based on an amount of time corresponding to the vehicle system traveling at an upper speed limit of the first route to the crossing.

3. The method of claim 1, further comprising determining if the one or more absolute times received from the vehicle system already has passed and, responsive to determining that the one or more absolute times received from the vehicle system already has passed, communicating a responsive message to the vehicle system that requests one or more additional absolute times from the vehicle system, wherein the one or more additional absolute times are received from the vehicle system and modified into the first relative time that is used to control the one or more warning devices.

4. The method of claim 1, further comprising tracking a system time of the one or more warning devices, determining whether the system time has been updated within a designated time period, wherein the system time is specified by a clock maintained by the one or more warning devices, and, responsive to determining that the system time has not been updated within the designated time period, communicating a responsive message to the vehicle system that requests one or more additional absolute times from the vehicle system, wherein the one or more additional absolute times are received from the vehicle system and modified into the first relative time that is used to control the one or more warning devices.

5. The method of claim 1, wherein receiving the one or more absolute times includes receiving plural different absolute times from the vehicle system and modifying the one or more absolute times includes modifying the plural different absolute times into plural different relative times, and wherein controlling the one or more warning devices includes controlling the one or more warning devices based on the first relative time of the plural different relative times that is a shorter time period than one or more other relative times of the plural different relative times.

6. The method of claim 1, wherein the one or more warning devices include a gate that is activated upon expiration of the first relative time to prevent passage of the one or more other vehicles through the crossing.

7. The method of claim 1, wherein the one or more warning devices include at least one of a light or a speaker that is activated upon expiration of the first relative time to notify of arrival of the vehicle system at the crossing.

8. The method of claim 1, wherein the first relative time represents a measurement of a time period extending from a current time until the vehicle system arrives at the crossing.

9. The method of claim 1, wherein the at least one of the one or more absolute times is modified into the first relative time due to modification of a clock associated with the one or more warning devices causing the at least one of the one or more absolute times to incorrectly indicate when the vehicle system arrives at the crossing.

10. The method of claim 1, wherein the one or more absolute times are synchronized with at least one of a time provided by a global positioning system or a time provided by a network time protocol.

11. The method of claim 1, wherein the one or more absolute times are expressed as at least one of coordinated universal time (UTC) or Greenwich mean time (GMT).

12. A system comprising:

a crossing module configured to receive one or more absolute times associated with movement of a vehicle system, the one or more absolute times communicated from the vehicle system to notify of at least one of an arrival or departure of the vehicle system at a crossing between a first route being traveled by the vehicle system and a second route, the one or more absolute times specified in accordance with a synchronization scheme used by additional entities in addition to the vehicle system, wherein the crossing module is configured to modify at least one of the one or more absolute times into a first relative time and to control one or more warning devices using the first relative time, the first relative time specified with reference to a particular event, the one or more warning devices controlled to at least one of notify one or more other vehicles traveling along the second route of the at least one of arrival or departure of the vehicle system at the crossing or prevent the one or more other vehicles from traveling through the crossing along the second route.

13. The system of claim 12, wherein the crossing module also is configured to compare a difference between a system time tracked by one or more clocks of the one or more warning devices and the one or more absolute times received from the vehicle system, wherein the crossing module also is configured to control the one or more warning devices responsive to the difference between the system time and the one or more absolute times received from the vehicle system being no greater than a designated threshold time period, the designated threshold time period based on an amount of time corresponding to the vehicle system traveling at an upper speed limit of the first route to the crossing.

14. The system of claim 12, wherein the crossing module also is configured to determine if the one or more absolute times received from the vehicle system already has passed and, responsive to determining that the one or more absolute times received from the vehicle system already has passed, the crossing module is configured to communicate a responsive message to the vehicle system that requests one or more additional absolute times from the vehicle system and, responsive to receiving the one or more additional absolute times from the vehicle system, the crossing module is configured to modify the one or more additional absolute times into the first relative time that is used to control the one or more warning devices.

15. The system of claim 12, wherein the crossing module is configured to determine when a system time tracked by one or more clocks of the one or more warning devices has been updated within a designated time period, and, responsive to determining that the system time has not been updated within the designated time period, the crossing module is configured to communicate a responsive message to the vehicle system that requests one or more additional absolute times from the vehicle system, to receive the one or more additional absolute times from the vehicle system, and to modify the one or more additional absolute times into the first relative time that is used to control the one or more warning devices.

16. The system of claim 12, wherein the crossing module is configured to receive the one or more absolute times as plural different absolute times, to modify the one or more absolute times into plural different relative times, and to control the one or more warning devices based on the first relative time of the plural different relative times that is a shorter time period than one or more other relative times of the plural different relative times.

17. The system of claim 12, wherein the crossing module is configured to at least one of control a gate that is activated upon expiration of the relative time to prevent passage of the one or more other vehicles through the crossing or at least one of a light or a speaker that is activated upon expiration of the first relative time to notify of arrival of the vehicle system at the crossing.

18. The system of claim 12, wherein the first relative time represents a measurement of a time period extending from a current time until the vehicle system arrives at the crossing.

19. The system of claim 12, wherein the crossing module is configured to modify the absolute time into the first relative time so that modification of a clock associated with the one or more warning devices causes the absolute time to incorrectly indicate when the vehicle system arrives at the crossing.

20. A system comprising:

a crossing module that includes one or more computer processors configured to receive an absolute time associated with movement of a first vehicle system along a first route toward a crossing between the first route and a second route, the absolute time representing at least one of an arrival time of the first vehicle system at the crossing or a departure time at which the vehicle system is expected to complete passage through the crossing, the absolute time specified in accordance with a synchronization scheme used by additional entities in addition to the vehicle system, wherein the crossing module is configured to modify the absolute time into a relative time, the relative time specified with reference to a particular event; and one or more warning devices including at least one of a gate or a light, wherein the crossing module is configured to at least one of: activate the gate upon expiration of the relative time to prevent passage of one or more other vehicles through the crossing along the second route, activate the light upon expiration of the relative time to notify the one or more other vehicles of arrival of the first vehicle system at the crossing, or activate the gate to prevent the one or more other vehicles from passing through the crossing along the second route until the relative time indicates that the first vehicle system has completed passage through the crossing along the first route.

21. The system of claim 20, wherein the crossing module is configured to receive the absolute time from the first vehicle system.

22. The system of claim 20, wherein the crossing module is configured to compare a difference between a system time of the one or more warning devices and the absolute time received from the vehicle system, wherein the crossing module is configured to control the one or more warning devices responsive to the difference between the system time and the absolute time received from the vehicle system being no greater than a designated threshold time period, the designated threshold time period based on an amount of time corresponding to the vehicle system traveling at an upper speed limit of the first route to the crossing.

* * * * *